US008448341B2

(12) United States Patent
Haney et al.

(10) Patent No.: US 8,448,341 B2
(45) Date of Patent: May 28, 2013

(54) BOW-SIGHT MOUNT

(75) Inventors: Edward J. Haney, Gaines, MI (US); Joshua Lee Varner, Commerce, MI (US)

(73) Assignee: Trijicon, Inc., Wixom, MI (US)

( * ) Notice: Subject to any disclaimer, the term of this patent is extended or adjusted under 35 U.S.C. 154(b) by 278 days.

(21) Appl. No.: 12/955,015

(22) Filed: Nov. 29, 2010

(65) Prior Publication Data

US 2011/0271944 A1 Nov. 10, 2011

Related U.S. Application Data

(60) Provisional application No. 61/331,173, filed on May 4, 2010.

(51) Int. Cl.
*F41B 5/00* (2006.01)

(52) U.S. Cl.
USPC ..... 33/265; 124/88

(58) Field of Classification Search
USPC ..... 33/265; 124/87, 88
See application file for complete search history.

(56) References Cited

U.S. PATENT DOCUMENTS

| | | | | |
|---|---|---|---|---|
| 4,166,324 | A | 9/1979 | Carollo et al. | |
| 4,514,907 | A * | 5/1985 | Saltzman | 33/265 |
| 5,228,204 | A | 7/1993 | Khoshnood | |
| 5,435,068 | A | 7/1995 | Thames et al. | |
| 5,442,861 | A | 8/1995 | Lorocco | |
| 5,465,491 | A | 11/1995 | Thell | |
| 5,511,317 | A * | 4/1996 | Allen | 33/265 |
| 5,524,351 | A * | 6/1996 | Pinson et al. | 33/265 |
| 5,651,185 | A * | 7/1997 | Vanderheyden et al. | 33/265 |
| 5,676,122 | A * | 10/1997 | Wiseby et al. | 124/87 |
| RE36,266 | E * | 8/1999 | Gibbs | 33/265 |
| 5,941,226 | A | 8/1999 | Marietta | |
| 5,975,069 | A | 11/1999 | Hamm et al. | |
| 6,000,141 | A | 12/1999 | Afshari | |
| 6,119,672 | A | 9/2000 | Closson | |
| 6,311,405 | B1 | 11/2001 | Slates | |
| 6,418,633 | B1 | 7/2002 | Rager | |
| 6,477,778 | B1 | 11/2002 | Lorocco | |
| 6,505,407 | B2 | 1/2003 | Savage | |
| 6,571,482 | B1 | 6/2003 | Tymianski | |
| 6,581,317 | B1 | 6/2003 | Slates | |
| 6,601,308 | B2 | 8/2003 | Khoshnood | |
| 6,609,306 | B2 | 8/2003 | Johnson et al. | |
| 6,634,110 | B2 | 10/2003 | Johnson | |

(Continued)

OTHER PUBLICATIONS

Non-Final Office Action in U.S. Appl. No. 12/955,033, dated Dec. 9, 2011.

(Continued)

*Primary Examiner* — Yaritza Guadalupe-McCall
(74) *Attorney, Agent, or Firm* — Harness, Dickey & Pierce, P.L.C.

(57) ABSTRACT

A sight mount is provided and may include a frame, a first bracket slidably supported by the frame, and an arm rotatably attached to the first bracket at a first pivot point and rotatably supported by the frame at a second pivot point. A first adjustment assembly may adjust a distance between the first pivot point and the second pivot point. A second adjustment assembly may include a rotatable wheel to pivot the arm about the second pivot in response to rotation of the wheel relative to the frame to move the first bracket relative to the frame.

44 Claims, 14 Drawing Sheets

U.S. PATENT DOCUMENTS

| | | | | |
|---|---|---|---|---|
| 6,634,111 | B2 | 10/2003 | LoRocco | |
| 6,651,350 | B1 * | 11/2003 | Manns et al. | 33/265 |
| 6,701,632 | B2 | 3/2004 | Henry | |
| 6,725,854 | B1 | 4/2004 | Afshari | |
| D489,427 | S | 5/2004 | Rager | |
| 6,817,105 | B2 | 11/2004 | LoRocco | |
| 6,867,432 | B1 | 3/2005 | Teramoto | |
| 6,892,462 | B2 | 5/2005 | Rager | |
| 6,925,721 | B2 | 8/2005 | Dietz | |
| 6,964,105 | B2 | 11/2005 | McLeod | |
| 7,082,690 | B1 | 8/2006 | Khoshnood | |
| 7,100,292 | B2 | 9/2006 | Afshari | |
| 7,117,604 | B2 | 10/2006 | Khoshnood | |
| 7,159,325 | B2 | 1/2007 | Rager | |
| RE39,686 | E | 6/2007 | Khoshnood | |
| 7,275,328 | B1 | 10/2007 | Rager | |
| 7,278,216 | B2 | 10/2007 | Grace | |
| 7,290,345 | B2 | 11/2007 | Ellig | |
| 7,308,891 | B2 | 12/2007 | Graf | |
| 7,343,686 | B2 * | 3/2008 | Rager | 33/265 |
| 7,360,313 | B1 | 4/2008 | Hamm et al. | |
| 7,461,460 | B2 | 12/2008 | Priebe | |
| 7,475,485 | B1 | 1/2009 | Hamm et al. | |
| 7,644,503 | B2 * | 1/2010 | Lewis | 33/265 |
| 7,721,453 | B1 | 5/2010 | Young | |
| 7,814,669 | B2 | 10/2010 | Kingsbury | |
| 7,832,109 | B2 | 11/2010 | Gibbs et al. | |
| 7,856,728 | B1 * | 12/2010 | Ozinga | 33/265 |
| 7,900,365 | B1 | 3/2011 | Johnson | |
| 8,006,395 | B2 | 8/2011 | Kingsbury | |
| 8,051,574 | B1 | 11/2011 | Kronengold et al. | |
| 8,069,577 | B1 | 12/2011 | Willman et al. | |
| 8,079,153 | B2 | 12/2011 | Pulkrabek et al. | |
| 8,151,473 | B2 | 4/2012 | Sims et al. | |
| 8,161,656 | B1 | 4/2012 | Ellgass | |
| 8,166,662 | B2 | 5/2012 | Williams | |
| 8,166,962 | B2 | 5/2012 | Volpe | |
| 8,171,648 | B2 | 5/2012 | Summers et al. | |
| 8,176,644 | B1 | 5/2012 | Summers et al. | |
| 8,186,068 | B2 | 5/2012 | Pulkrabek et al. | |
| 2002/0042999 | A1 | 4/2002 | Lorocco | |
| 2002/0062569 | A1 | 5/2002 | Slates | |
| 2002/0073560 | A1 | 6/2002 | LoRocco | |
| 2002/0100176 | A1 | 8/2002 | Savage | |
| 2002/0100177 | A1 | 8/2002 | Savage | |
| 2002/0112358 | A1 | 8/2002 | Savage | |
| 2003/0056379 | A1 | 3/2003 | Johnson et al. | |
| 2003/0110647 | A1 | 6/2003 | Henry | |
| 2003/0121163 | A1 | 7/2003 | Khoshnood | |
| 2006/0254065 | A1 | 11/2006 | Grace | |
| 2008/0104854 | A1 | 5/2008 | Hamm et al. | |
| 2008/0115373 | A1 | 5/2008 | Rager | |
| 2008/0289201 | A1 | 11/2008 | Kroening, Jr. | |
| 2009/0000134 | A1 | 1/2009 | Kurtzhals et al. | |
| 2009/0133272 | A1 | 5/2009 | Lewis | |
| 2009/0139101 | A1 | 6/2009 | Labowski | |
| 2010/0258628 | A1 | 10/2010 | Bay | |
| 2011/0023311 | A1 | 2/2011 | Williams | |
| 2011/0072672 | A1 | 3/2011 | Hoffman | |
| 2011/0167654 | A1 | 7/2011 | Pulkrabek et al. | |
| 2011/0167655 | A1 | 7/2011 | Pulkrabek et al. | |
| 2011/0167706 | A1 | 7/2011 | Glock | |
| 2011/0214304 | A1 | 9/2011 | Priebe | |
| 2011/0271536 | A1 | 11/2011 | Logsdon | |
| 2011/0271943 | A1 | 11/2011 | Maynard | |
| 2011/0271944 | A1 * | 11/2011 | Haney et al. | 33/265 |
| 2011/0277329 | A1 | 11/2011 | Summers et al. | |
| 2012/0102767 | A1 | 5/2012 | Pulkrabek et al. | |

OTHER PUBLICATIONS

Vital Bow Gear, "http://www.vitalbowgear.com/tombstone.cfm".
Inside Archery (magazine), "Vital Bow Gear," Jun. 2004, p. 61.
Cobra Bowhunting Products, "2003 Product Catalog," Cobra Manufacturing Co., Inc., Bixby, OK.
Trophy Ridge, "2003 Catalog," Trophy Ridge, LLC, Belgrade, MT.
TRUGLO, "2003 Catalog," TRUGLO, Inc., McKinney, TX.

* cited by examiner

BOW-SIGHT MOUNT

CROSS-REFERENCE TO RELATED APPLICATIONS

This application claims the benefit of U.S. Provisional Application No. 61/331,173 filed on May 4, 2010. The entire disclosure of the above application is incorporated herein by reference.

FIELD

The present disclosure relates to a sight mount and more particularly to an adjustable bow-sight mount.

BACKGROUND

This section provides background information related to the present disclosure which is not necessarily prior art.

Archery bows are often used for hunting and/or target shooting. In both of these applications, accuracy is a significant concern. To facilitate accurate shooting, a bow may include a sight to help an archer align an arrow with a selected target. Many factors contribute to the proper alignment of a sight relative to the bow, including distance to the target, relative positioning of the archer and the target, velocity of the arrow, and wind, for example. One or more of these factors may vary throughout the course of a hunt or a target-shooting exercise or event. Accordingly, an adjustable sight mount may be used to attach the sight to the bow and to adjust the alignment between the sight and the bow depending on present shooting conditions.

SUMMARY

This section provides a general summary of the disclosure, and is not a comprehensive disclosure of its full scope or all of its features.

A sight mount is provided and may include a frame, a first bracket slidably supported by the frame, and an arm rotatably attached to the first bracket at a first pivot point and rotatably supported by the frame at a second pivot point. A first adjustment assembly may adjust a distance between the first pivot point and the second pivot point. A second adjustment assembly may include a rotatable wheel to pivot the arm about the second pivot in response to rotation of the wheel relative to the frame to move the first bracket relative to the frame.

In another configuration, a sight mount is provided and may include a frame, an arm rotatably supported by the frame about a first pivot point, and an adjustment wheel rotatably supported by the frame. The adjustment wheel may rotate the arm about the first pivot to adjust a position of the arm relative to the frame and may include a plurality of detents selectively engaging the arm to produce an audible indication of an amount of rotation of the adjustment wheel.

In yet another configuration, a sight mount is provided and may include a frame and a first bracket. The first bracket may be supported by the frame for movement relative thereto and may include a first socket. A second bracket may be supported by the first bracket to support a sight and may include a second socket. A ball member may be at least partially received within the first socket and may be at least partially received within the second socket to allow the second bracket to pivot about at least two axes relative to the first bracket.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
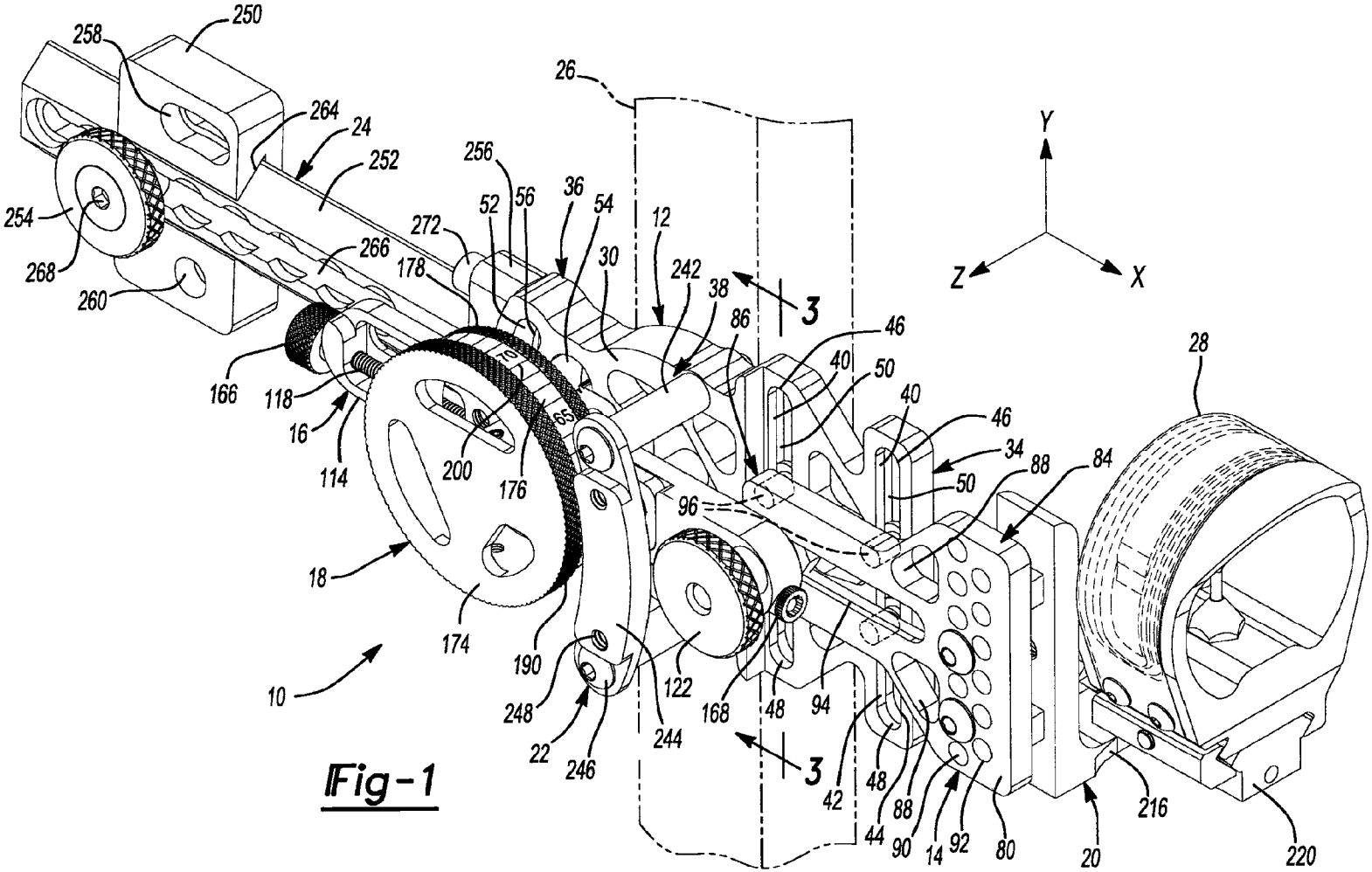
FIG. 1 is a perspective view of a first side of a bow-sight mount according to the principles of the present disclosure.
Figure 2:
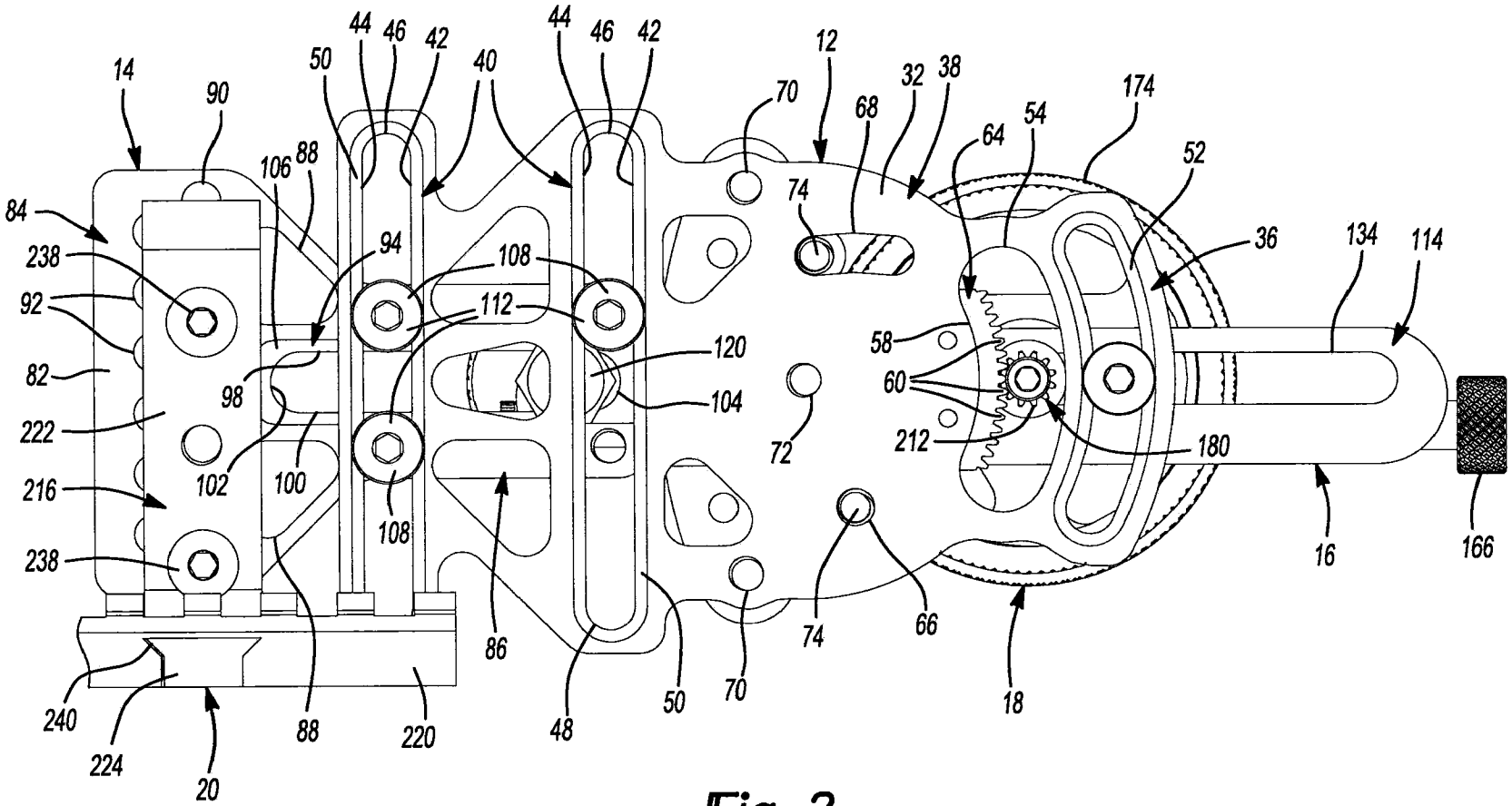
FIG. 2 is plan view of a second side of the bow-sight mount of FIG. 1.
Figure 3:
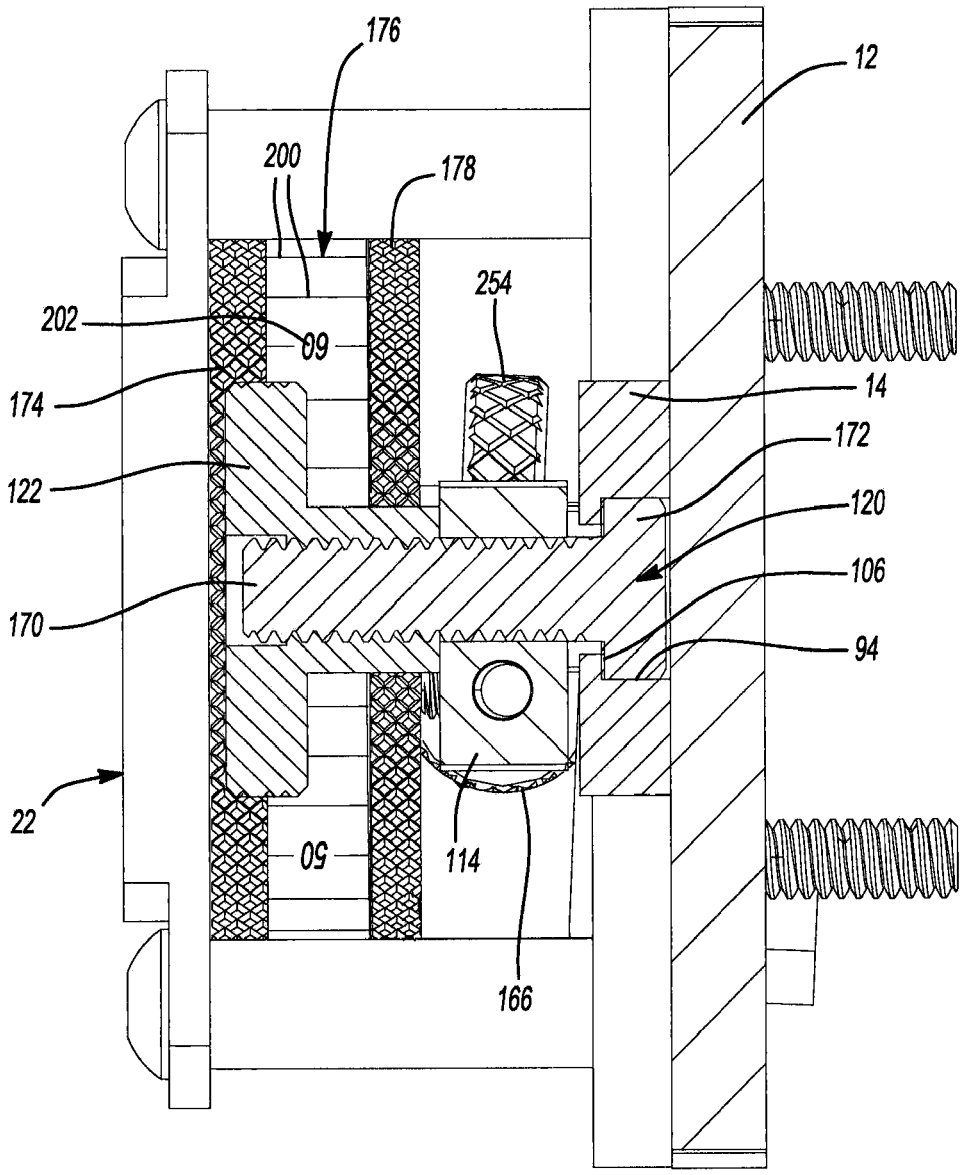
FIG. 3 is a cross-sectional view of the bow-sight mount of FIG. 1 taken along line 3-3.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-13, a bow-sight mount 10 is provided and may include a frame 12, an elevation member 14, a lever arm 16, an elevation-adjustment mechanism 18, a sight-bracket assembly 20, a quiver-attachment bracket 22, and an extension arm 24. The bow-sight mount 10 may be mounted to an archery bow 26 (FIG. 1) and may adjust a position of an optical component or sight 28 (FIG. 1) relative to the bow 26 based on a distance from a target and a velocity of an arrow shot from the bow 26, as will be subsequently described.

The frame 12 may be a generally flat member and may include a first side 30 (FIGS. 1, 5-8, and 10) and a second side 32 (FIG. 2) defining a first-end portion 34, a second-end portion 36, and a central portion 38. The first-end portion 34, the second-end portion 36 and/or the central portion 38 may include one or more recesses or cutouts 39 to reduce the weight of the frame 12. The frame 12 may be extruded, cast, machined, and/or otherwise formed from a relatively stiff metallic or composite material, for example. Exposed surfaces of the frame 12 may be anodized, plated, and/or otherwise treated to improve strength, durability and aesthetic appeal.

The first-end portion 34 may include one or more guide slots 40 extending through the first and second sides 30, 32. Each of the guide slots 40 may include a first elongated side 42 and a second elongated side 44 extending substantially parallel to each other in a first dimension Y. First and second opposing arcuate ends 46, 48 connect the first and second elongated sides 42, 44. The guide slots 40 may also include a recess 50 extending from the second side 32 of the frame 12 in a second dimension Z that is substantially perpendicular to the first dimension Y.

Figure 5:
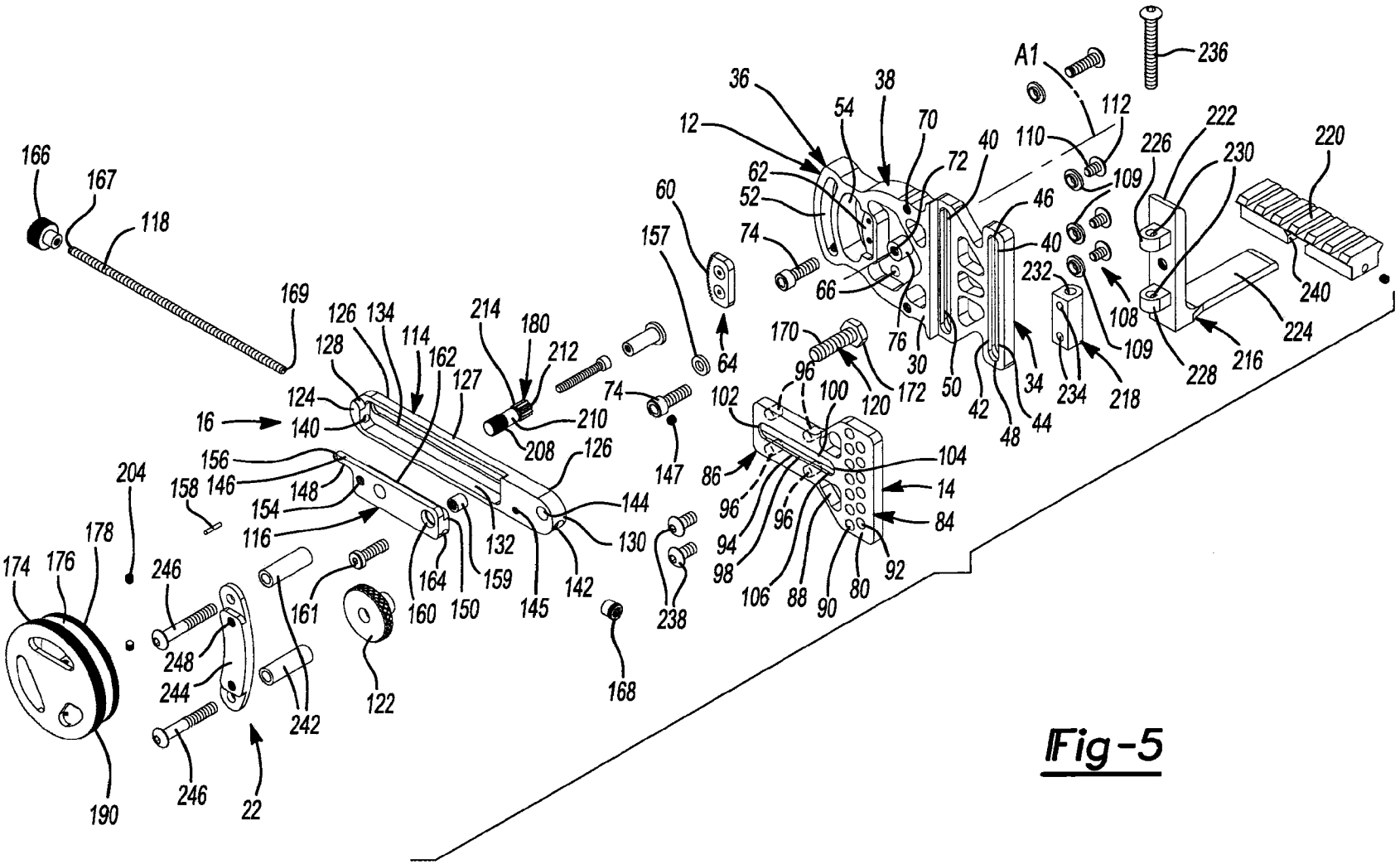
FIG. 5 is an exploded perspective view of the bow-sight mount of FIG. 1.

The second-end portion 36 may include a plurality of threaded extension-arm-mounting holes 51 (FIG. 10), a first arcuate slot 52 extending therethrough and a second arcuate slot 54 extending therethrough. The first arcuate slot 52 may include an inwardly extending shoulder 56. An inner arcuate side 58 of the second arcuate slot 54 may include a plurality of integrally formed and arcuately arranged teeth 60 (FIG. 10) forming a gear rack extending into the second arcuate slot 54. Alternatively, the first side 30 of the frame 12 may include a recess 62 that is connected to the second arcuate slot 54 and receives a plate 64 extending into the second arcuate slot 54, as shown in FIG. 5. In such embodiments, the arcuately arranged teeth 60 are integrally formed with the plate 64 rather than the second arcuate slot 54, as described above.

The central portion 38 is disposed between the first- and second-end portions 34, 36 and may include a mounting aperture 66, an arcuate mounting slot 68, a plurality of threaded quiver-bracket-mounting apertures 70, and a pivot aperture 72. Threaded fasteners 74 may be disposed through the mounting aperture 66 and the arcuate mounting slot 68 and may threadably engage the bow 26. Prior to tightening the fasteners 74 to the bow 26, the frame 12 can be pivoted relative to the bow 26 about an axis defining the mounting aperture 66. The arcuate mounting slot 68 allows for several degrees of tilt-adjustment to fine-tune the position of the frame 12 relative to the bow 26.

The pivot aperture 72 may extend through a post 76 that may be integrally formed with the central portion 38. The pivot aperture 72 may be a threaded hole defined by an axis A1 (FIGS. 5 and 10) extending longitudinally therethrough in the second dimension Z. Radii of curvature of the first and/or second arcuate slots 52, 54 may extend from points along the axis A1.

The elevation member 14 may be a generally flat member and may include a first side 80 (FIG. 1) and a second side 82 (FIG. 2) defining a first portion 84 and a second portion 86. The first portion 84 and/or the second portion 86 may include one or more recesses or cutouts 88 to reduce the weight of the elevation member 14. The elevation member 14 may be extruded, cast, machined, and/or otherwise formed from a relatively stiff metallic or composite material, for example. Exposed surfaces of the elevation member 14 may be anodized, plated, and/or otherwise treated to improve strength, durability, and aesthetic appeal.

The first portion 84 may include a plurality of first-mounting apertures 90 and a plurality of second-mounting apertures 92. The plurality of first-mounting apertures 90 may be arranged in a first linear array extending in the first dimension Y. The plurality of second-mounting apertures 92 may be arranged in a second linear array extending in the first dimension Y substantially parallel to the first linear array of first-mounting apertures 90. Each of the plurality of second-mounting apertures 92 may be misaligned relative to each of the plurality of first-mounting apertures 90 in a third dimension X that is substantially perpendicular to the first and second dimensions Y, Z such that each of the second-mounting apertures 92 is disposed between a pair of first-mounting apertures 90. Stated another way, each of the plurality of second-mounting apertures 92 may be spaced apart from each of the plurality of first-mounting apertures 90 in the first dimension Y.

The second portion 86 may extend from the first portion 84 in the third dimension X forming a generally T-shaped member (shown best in FIG. 5). Alternatively, the first and second portions 84, 86 could arranged relative to each other to form a generally L-shaped member. The second portion 86 may include a guide slot 94 and a plurality of apertures 96. The guide slot 94 may extend through the first and second sides 80, 82 of the elevation member 14 and may include first and second elongated sides 98, 100 and first and second arcuate ends 102, 104. The first and second elongated sides 98, 100 may be substantially parallel to each other and extend in the third dimension X. The first and second arcuate ends 102, 104 connect the first and second elongated sides 98, 100 at opposite ends thereof. The guide slot 94 may also include a recess 106 extending from the second side 82 in the second dimension Z.

The plurality of apertures 96 may engage guide members 108 that may extend from the second side 82 of the elevation member 14 in the second dimension Z. The guide members 108 may be threaded fasteners or rivets, for example, and may include a shaft portion 110 and a head portion 112. The guide members 108 may engage bushings 109 and slidably engage the guide slots 40 of the frame 12 to allow the elevation member 14 to move relative to the frame 12 in the first dimension Y. The head portions 112 of the guide members 108 may be received in the recesses 50 of the guide slots 40.

The lever arm 16 may include a first-elongated member 114, a second-elongated member 116, an adjustment rod 118, a guide member 120, and a locking nut or knob 122. The first and second elongated members 114, 116 and the adjustment rod 118 may cooperate to form an adjustment mechanism that selectively moves the guide member 120 relative to the elevation member 14.

As shown in FIG. 5, the first-elongated member 114 may include a first side 124, a second side 126, a top side 127, a first end 128, and a second end 130. An elongated recess 132 may be formed in the first side 124 and may extend longitudinally in the third dimension X. An elongated slot 134 may be disposed in the elongated recess 132. The elongated slot 134 may extend longitudinally in the third dimension X and may have a depth extending through the second side 126.

Figure 4:
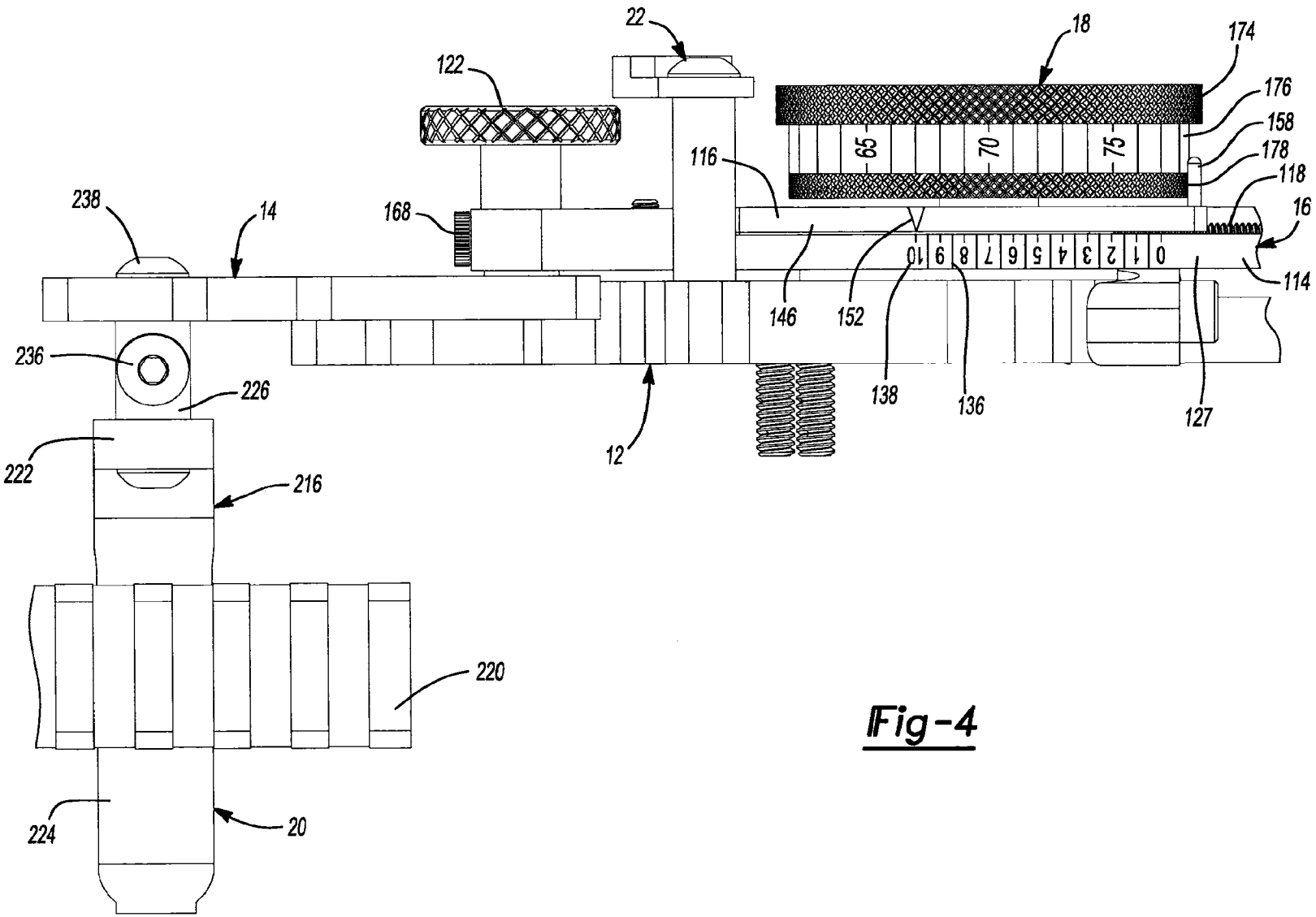
FIG. 4 is a top plan view of the bow-sight mount of FIG. 1.

The top side 127 of the first-elongated member 114 may include a plurality of bow-speed graduation marks 136 and numbers 138 and/or other characters corresponding to at least some of the bow-speed graduation marks 136 (FIG. 4). The bow-speed graduation marks 136 and numbers 138 may be laser-etched, printed, painted, scribed, or otherwise marked thereon. The bow-speed graduation marks 136 may correspond to an arrow speed (i.e., a velocity at which the bow 26 shoots an arrow (not shown)).

The first end 128 of the first-elongated member 114 may include a first aperture 140 that extends through to the elongated recess 132. The second end 130 of the first-elongated member 114 may likewise include a second aperture 142 that extends through to the elongated recess 132. The second aperture 142 may be threaded and concentric with the first aperture 140. A third aperture 144 may extend through the first and second sides 124, 26 of the first-elongated member 114 proximate to the second end 130. A threaded aperture 145 proximate to the second end 130 may extend substantially perpendicular to the second aperture 142 and may communicate with the second aperture 142. A set screw 147 may threadably engage the threaded aperture 145 and may selectively engage the adjustment rod 118 to fix the first-elongated member 114 relative to the second-elongated member 116.

The second-elongated member 116 may be slidably received in the elongated recess 132 of the first-elongated member 114 and may include an edge 146, a first end portion 148, and a second end portion 150. As shown in FIG. 4, the edge 146 may include an indicator 152 that can be selectively aligned with one of the bow-speed graduation marks 136 on the first-elongated member 114 to indicate a position of the first-elongated member 114 relative to the second-elongated member 116. The indicator 152 may include a line, triangle, arrow or any other indicia laser-etched, printed, painted, scribed, or otherwise marked on the edge 146.

The first end portion 148 of the second-elongated member 116 may include a first aperture 154 and an arm 156 having an indicator pin 158 extending therefrom. The first aperture 154 may extend through the first end portion 148 and may be aligned with the elongated slot 134 in the first-elongated member 114 and the first arcuate slot 52 in the frame 12.

The second end portion 150 may include a counterbored second aperture 160 that may extend therethrough and may be aligned with the elongated slot 134 in the first-elongated member 114 and the pivot aperture 72 in the frame 12. A first annular bushing 157 may be disposed between the first-elongated member 114 and the post 76 of the frame 12. A second annular bushing 159 may be disposed between the first-elongated member 114 and the second-elongated member 116. The first and second annular bushings 157, 159 may be aligned with the pivot aperture 72 and the elongated slot 134 in the first-elongated member 114. The annular bushing 157 may act as a bearing between the lever arm 16 and the frame 12. A fastener 161 (FIGS. 5-7) may extend through the second end portion 150, through the elongated slot 134 of the first-elongated member 114, through the second annular bushing 159 and may threadably engage the pivot aperture 72. The fastener 161 may be rotationally fixed relative to the pivot aperture 72 and may support the lever arm 16 for rotation about the axis A1 extending through the pivot aperture 72 and the fastener 161.

A third aperture 162 may extend through the second-elongated member 116 and may be disposed between the first and second apertures 154, 160. The third aperture 162 may be aligned with the elongated slot 134 in the first-elongated member 114 and the second arcuate slot 54 in the frame 12. A fourth aperture 164 may extend through the first and second end portions 148, 150 substantially perpendicular to the first, second and third apertures 154, 160, 162 and may be aligned with the first and second apertures 140, 142 in the first-elongated member 114. The fourth aperture 164 may include threads engaging the adjustment rod 118.

The adjustment rod 118 may be an elongated threaded rod having an adjustment knob 166 fixed to a first end 167 and a cap 168 fixed to a second end 169. The adjustment rod 118 may extend through the first and second apertures 140, 142 in the first-elongated member 114, through the fourth aperture 164 in the second-elongated member 116, and may threadably engage the threads of the fourth aperture 164. In this manner, rotation of the adjustment rod 118 relative to the first and second elongated members 114, 116 causes relative linear movement between the first and second elongated members 114, 116.

The guide member 120 may be a threaded fastener, for example, such as a hex-head bolt. The guide member 120 may include a threaded shaft portion 170 and a head portion 172. The guide member 120 may engage the third aperture 144 of the first-elongated member 114 and slidably engage the guide slot 94 of the elevation member 14. The head portion 172 may be received in the recess 106 of the guide slot 94. The shaft portion 170 may extend through the guide slot 94 and the third aperture 144. In this manner, the first-elongated member 114 and the guide member 120 may be movable relative to the elevation member 14 in the third dimension X.

The locking knob 122 may threadably engage the shaft portion 170 of the guide member 120. Tightening the locking knob 122 onto the guide member 120 increases friction between the guide member 120 and the elevation member 14 and between the elevation member 14 and the first-elongated member 114, thereby restricting or preventing relative movement between the first-elongated member 114 and the elevation member 14. The locking knob 122 can be loosened to allow free relative movement between the guide member 120 and the elevation member 14 and between the elevation member 14 and the first-elongated member 114.

Figure 9:
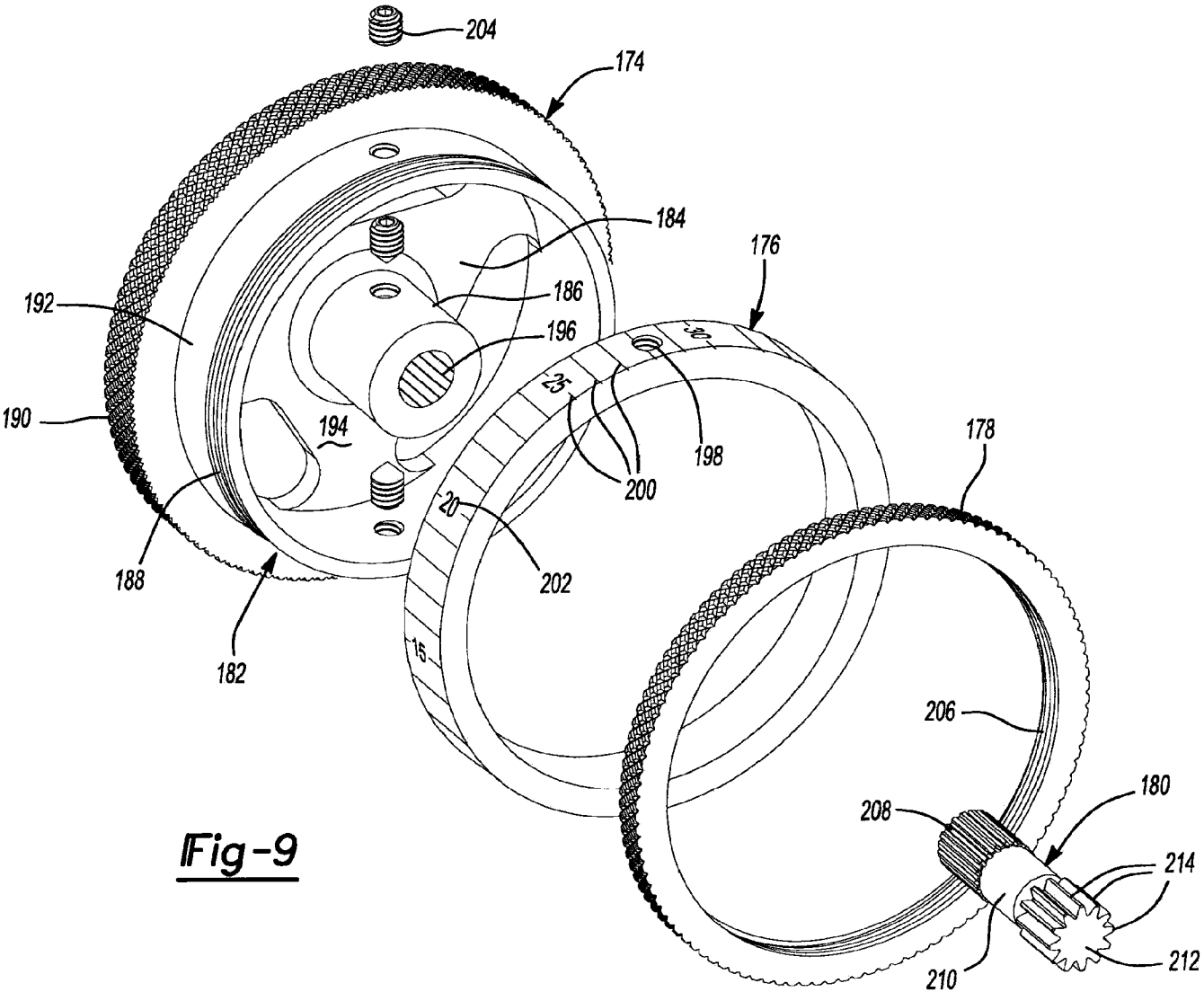
FIG. 9 is an exploded perspective view of an elevation adjustment mechanism of the bow-sight mount of FIG. 1.
Figure 10:
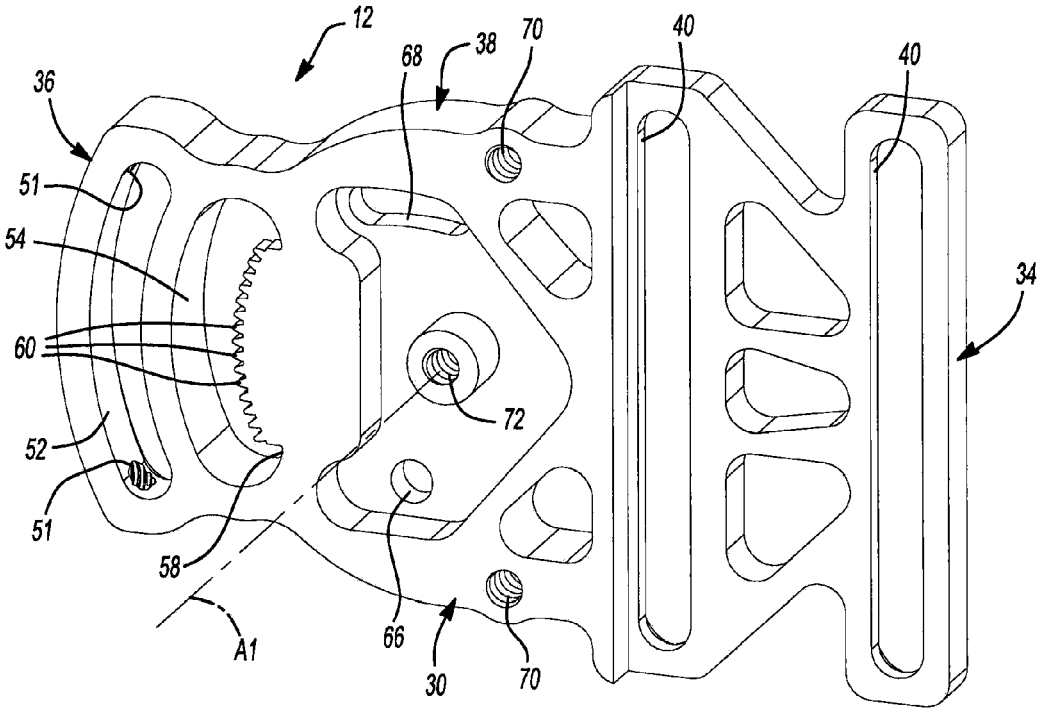
FIG. 10 is a perspective view of a frame for use with a bow-sight mount according to the principles of the present disclosure.
Figure 11:
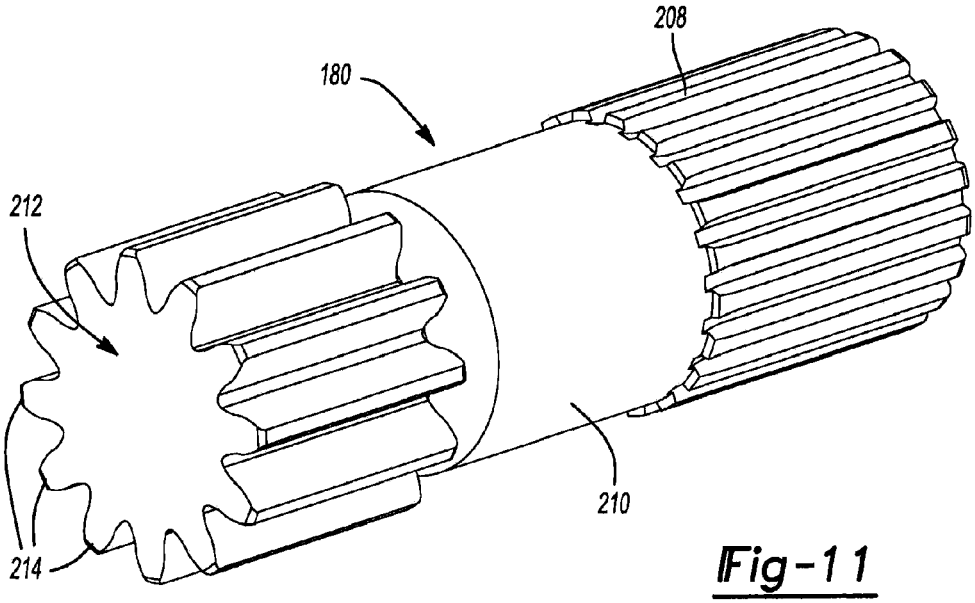
FIG. 11 is a perspective view of a rotation member for use with a bow-sight mount according to the principles of the present disclosure.

With particular reference to FIG. 9, the elevation-adjustment mechanism 18 may include an adjustment dial 174, a range ring 176, a locking dial 178 and a rotation member 180. The adjustment dial 174 may be a generally cup-shaped member and may include an circumferential portion 182, a flat portion 184, and a cylindrical boss 186. The circumferential portion 182 may include a threaded end portion 188, a knurled rim 190, and a smooth portion 192 disposed between the threaded end portion 188 and the knurled rim 190. The cylindrical boss 186 may be concentric with the circumferential portion 182, may extend axially from an inner surface 194 of the flat portion 184 in the second dimension Z, and may include a splined aperture 196 extending at least partially therethrough.

The range ring 176 may rotatably engage the smooth portion 192 of the adjustment dial 174 between the knurled rim 190 and the locking dial 178. The range ring 176 may include a threaded aperture 198, a plurality of range-graduation marks 200, numbers 202, and/or other characters corresponding to at least some of the range-graduation marks 200. The threaded aperture 198 may receive a set screw 204 that may be tightened against the smooth portion of the adjustment dial 174 to prevent or restrict relative rotation between the range ring 176 and the adjustment dial 174. The range-graduation marks 200 and numbers 202 may be laser-etched, printed, painted, scribed, or otherwise marked thereon. The range-graduation marks 200 may represent a distance between the bow 26 and an intended target for use in aligning the bow 26 relative to the target. The indicator pin 158 attached to the second-elongated member 116 of the lever arm 16 may be aligned with a selected one of the range-graduation marks 200.

The locking dial 178 may be a knurled ring having internal threads 206 that engage the threaded end portion 188 of the adjustment dial 174. Threadably tightening the locking dial 178 against the range ring 176 increases friction between the range ring 176 and the knurled rim 190 and between the range ring 176 and the locking dial 178, thereby restricting or preventing relative rotation between the range ring 176 and the adjustment dial 174.

The rotation member 180 may include a splined portion 208, a bearing portion 210, and a gear portion 212. The splined portion 208 may engage the splined aperture 196 in the cylindrical boss 186 of the adjustment dial 174 to fix the adjustment dial 174 for rotation with the rotation member 180. The bearing portion 210 may be disposed between the splined portion 208 and the gear portion 212. The bearing portion 210 may extend through the third aperture 162 in the second-elongated member 116 and through the elongated slot 134 in the first-elongated member 114. The gear portion 212 may extend from the bearing portion 210 into the second arcuate slot 54 in the frame 12. The gear portion 212 may include a plurality of teeth 214 that meshingly engage the arcuately arranged teeth 60 of the frame 12. The splined portion 208, the bearing portion 210, and the gear portion 212 may be integrally formed with each other.

The sight-bracket assembly 20 may include a sight bracket 216, a hinge member 218, and a mounting rail 220. The sight bracket 216 may be a generally L-shaped member including a first leg 222 extending in the first dimension Y and a second leg 224 extending in the second dimension Z. The first leg 222 may include first and second flanges 226, 228 having apertures 230 extending therethrough (FIG. 5) and aligned with each other in the first dimension Y. The second leg 224 may include a substantially dovetail-shaped cross section.

Figure 12:
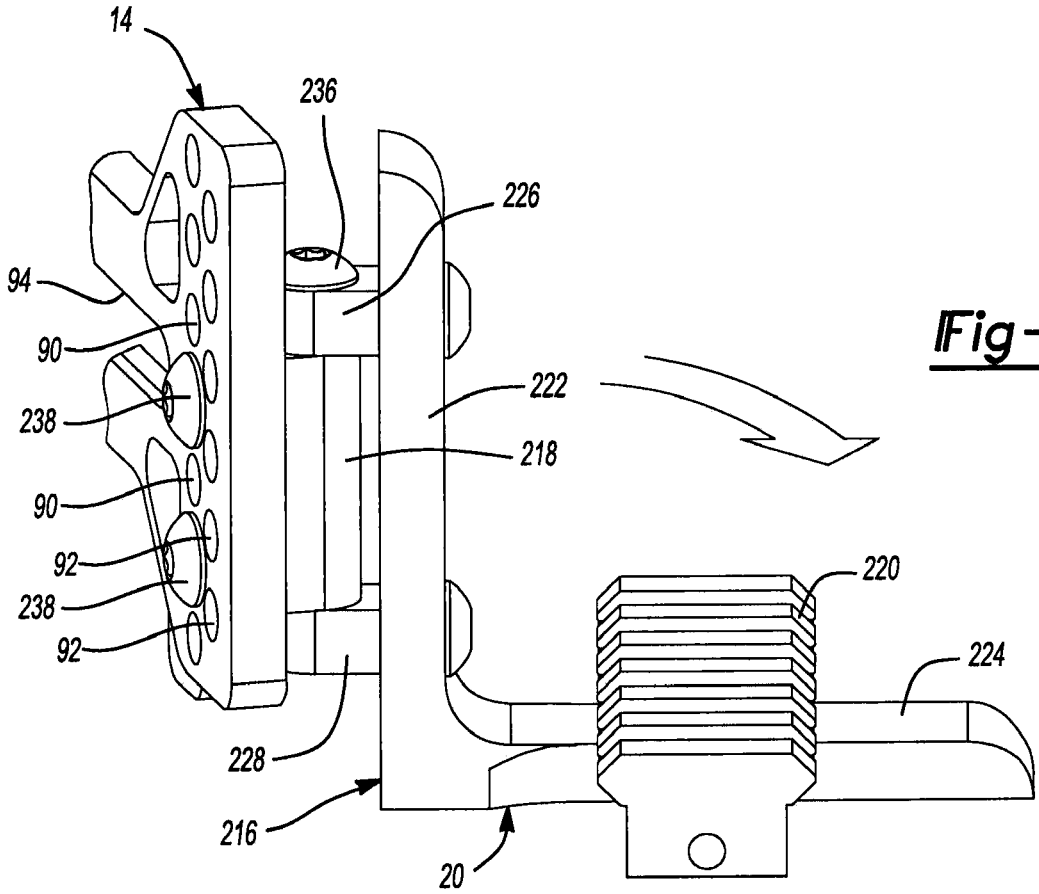
FIG. 12 is a perspective view of a sight bracket mounted to an elevation member for use with a bow-sight mount according to the principles of the present disclosure.
Figure 13:
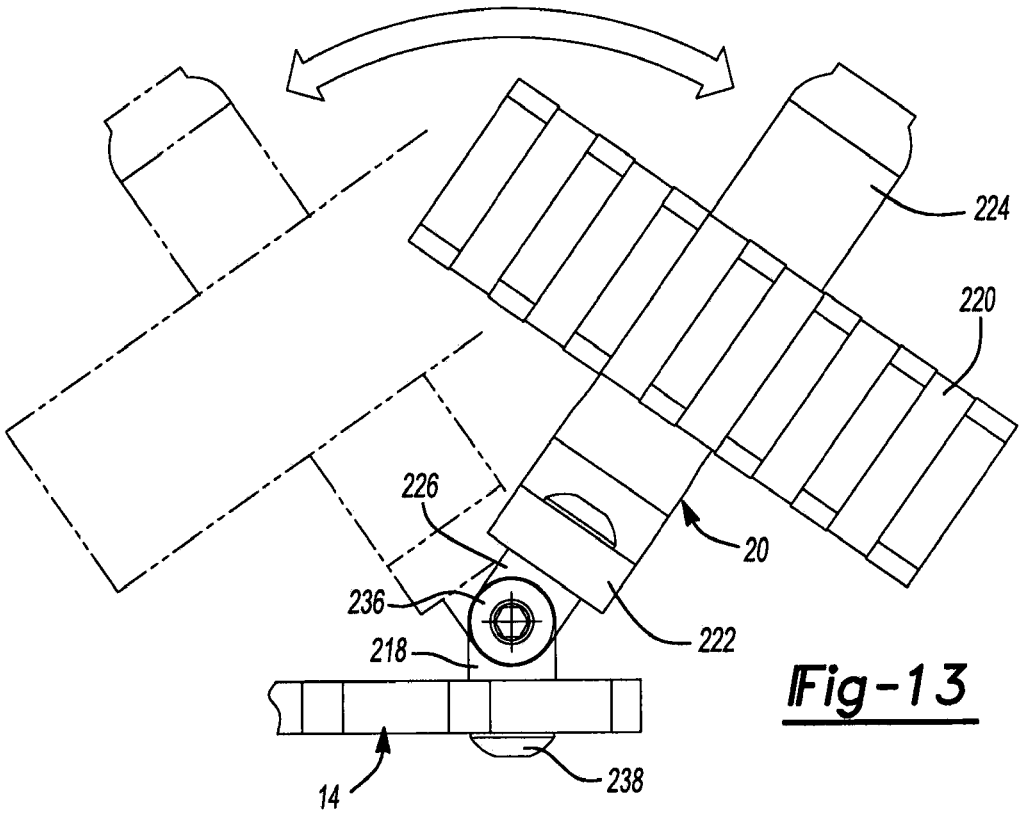
FIG. 13 is a top plan view of the sight bracket and elevation member of FIG. 12 illustrating relative motion therebetween.
Figure 14:
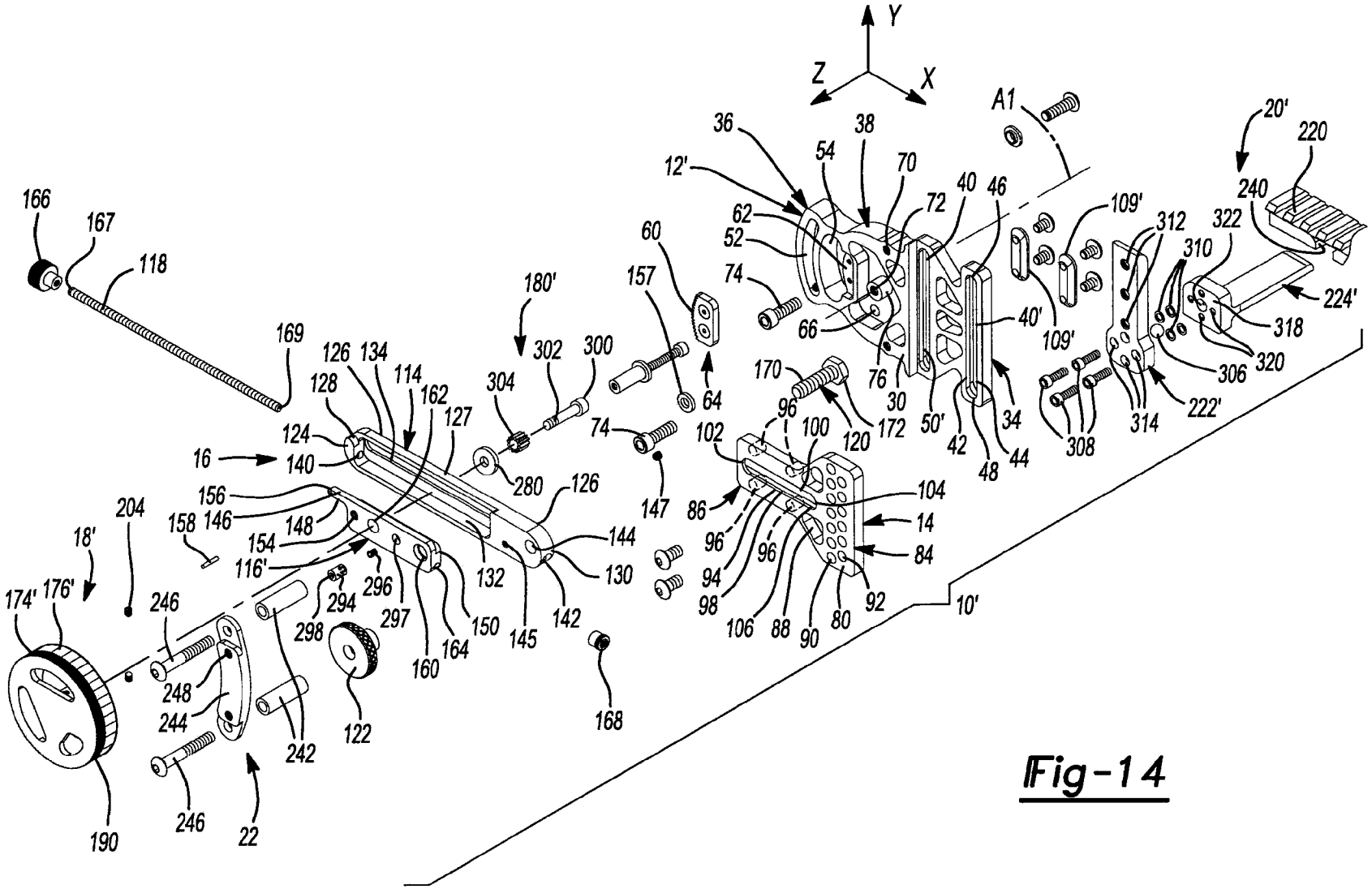
FIG. 14 is an exploded perspective view of another bow-sight mount according to the principles of the present disclosure.
Figure 15:
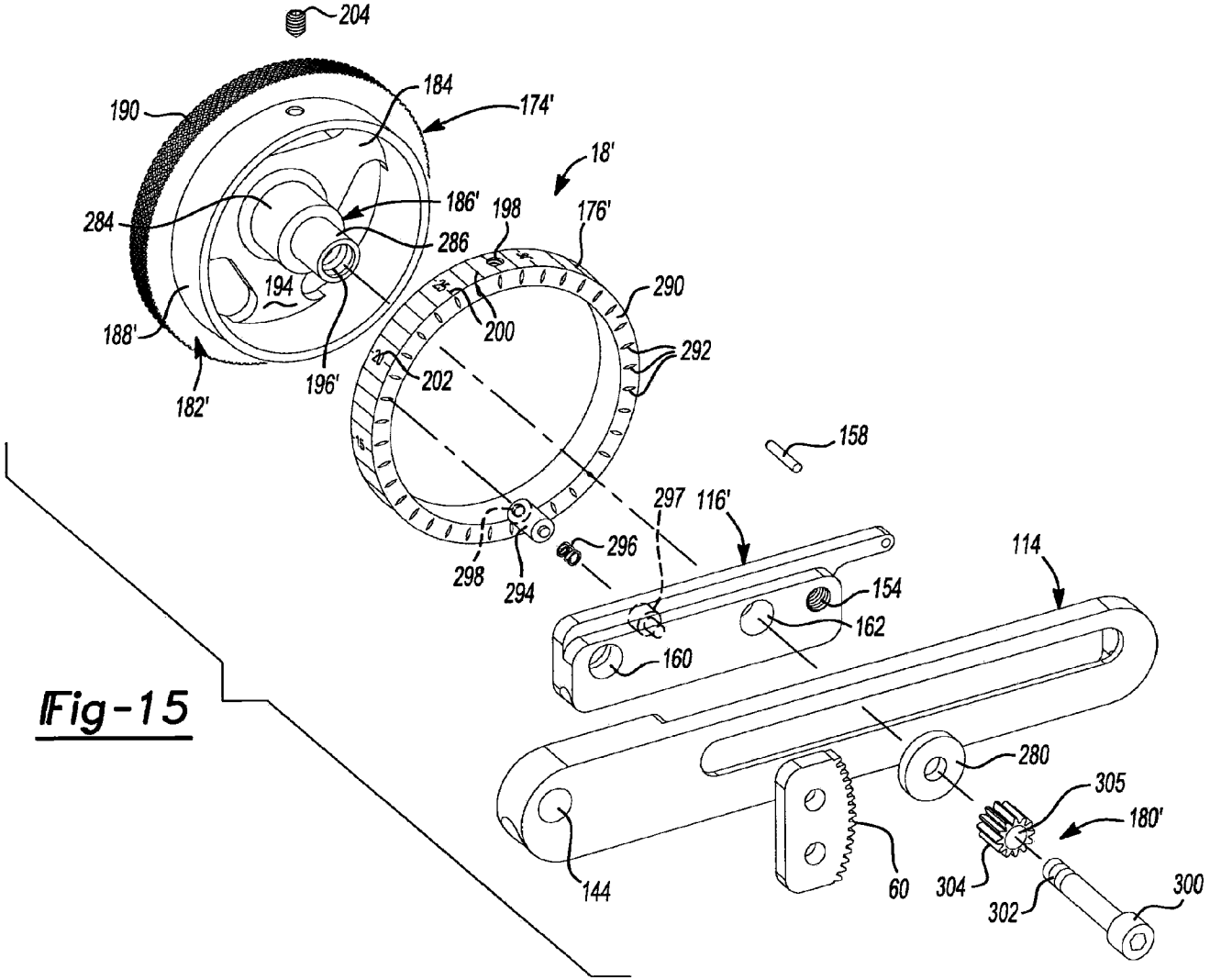
FIG. 15 is an exploded perspective view of an elevation-adjustment mechanism of the bow-sight mount of FIG. 14.
Figure 16:
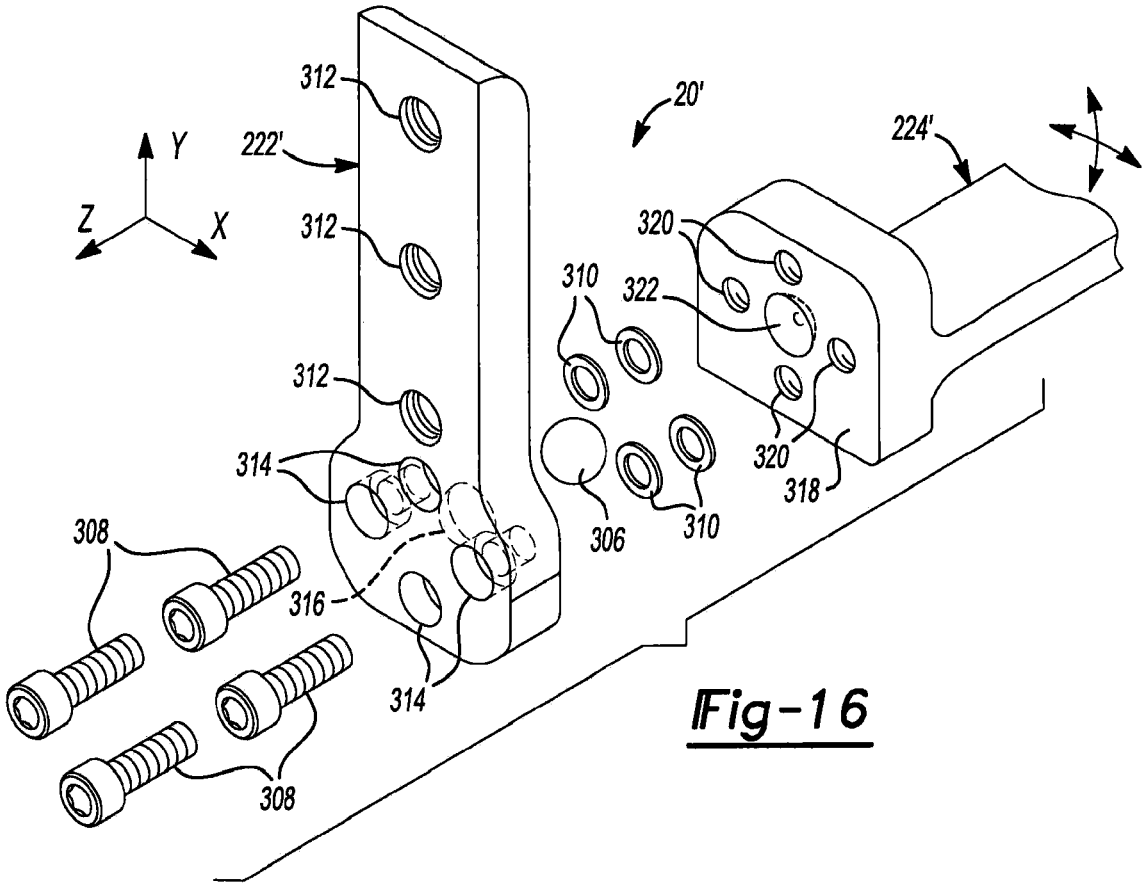
FIG. 16 is an exploded perspective view of a sight-bracket assembly according to the principles of the present disclosure.
Figure 17:
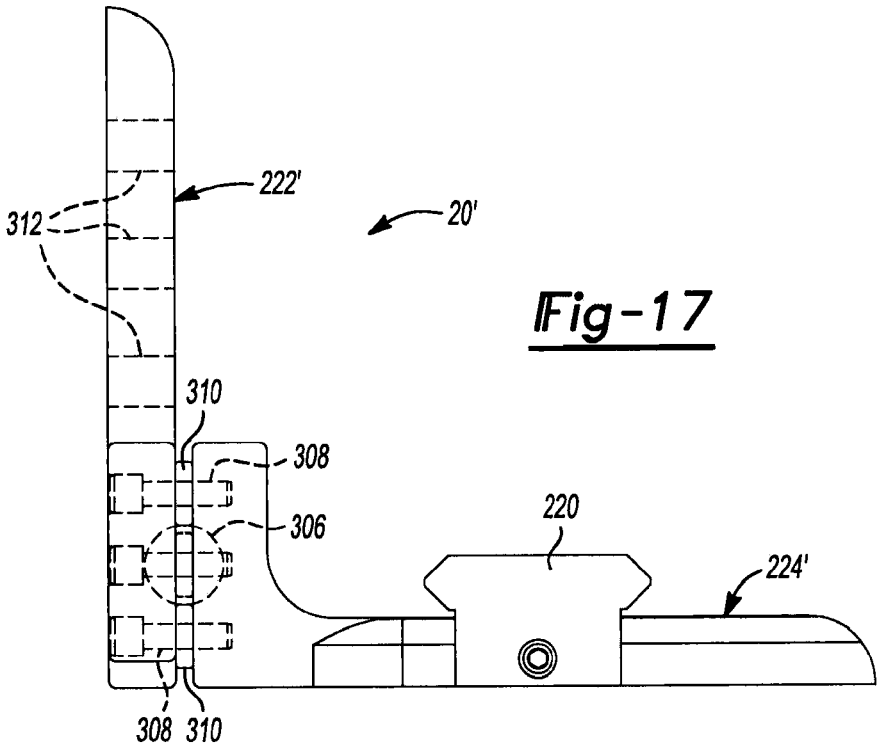
FIG. 17 is a side view of the sight-bracket assembly of FIG. 16.

The hinge member 218 may include a hinge aperture 232 and a pair of mounting apertures 234 (FIG. 5). A fastener or hinge pin 236 may engage the hinge aperture 232 and the apertures 230 extending through the first and second flanges 226, 228 of the sight bracket 216. In this manner, the sight bracket 216 may be pivotable about the hinge pin 236 relative to the hinge member 218 (FIGS. 12 and 13). The pair of mounting apertures 234 may be spaced apart from each other in the first dimension Y such that the mounting apertures 234 can be aligned with a selected pair of the plurality of first-mounting apertures 90 or a selected pair of the plurality of second-mounting apertures 92 in the elevation member 14. A pair of fasteners 238 may engage the selected pair of mounting apertures 90 or 92 and the mounting apertures 234. While the sight bracket 216 has been described as being connected to the elevation member 14 via the hinge member 218, the sight bracket 216 could alternatively be connected directly to the elevation member 14. In such a construction, the first and second flanges 226, 228 would be obviated to permit the first leg 222 to be directly attached to the mounting apertures 90, 92 via fasteners 238 and mounting apertures (not shown) formed through the first leg 227.

The mounting rail 220 may be an elongated member extending in the third dimension X and may include a dovetail slot 240 that may slidably engage the dovetail-shaped cross section of the second leg 224 of the sight bracket 216. The optical component or sight 28 may slidably engage the mounting rail 220 (FIG. 1). In this manner, the sight 28 may be adjustable relative to the elevation member 14 in both the second dimension Z for windage and in the third dimension X. The sight 28 may be of the type disclosed in assignee's commonly owned patent application, U.S. Ser. No. 61/331,106 filed on May 4, 2010, which is incorporated herein by reference.

The quiver-attachment bracket 22 may include a pair of posts 242 and a mounting member 244. A pair of threaded fasteners 246 may secure the mounting member 244 and the posts 242 to the quicker-bracket-mounting apertures 70 in the frame 12. The mounting member 244 may include one or more attachment apertures 248 that engage fasteners (not shown) to secure a quiver (not shown) to the quiver-attachment bracket 22.

The extension arm 24 may optionally be attached to the frame 12. In such a configuration, the extension arm 24 may be mounted to the bow 26, rather than the frame 12 being mounted to the bow 26, as described above. The extension arm 24 may be utilized for competition spot-shooting, for example, although its utility is not limited to such applications.

The extension arm 24 may include a mounting bracket 250, a rail 252, a knob 254, and an attachment bracket 256. The mounting bracket 250 may include a mounting slot 258, a mounting aperture 260, and a dovetail slot 264. The mounting slot 258 and mounting aperture 260 may be aligned with corresponding mounting holes (not shown) in the bow 26. The rail 252 may include a dovetail cross section having an elongated slot 266 that slidably engages the dovetail slot 264 of the mounting bracket 250. The knob 254 may include a threaded shaft 268 that may be inserted through the elongated slot 266 in the rail 252 and engage a threaded aperture in the mounting bracket 250. The knob 254 may be threadably tightened to secure the rail 252 in a desired position relative to the mounting bracket 250. The attachment bracket 256 may include apertures (not shown) that correspond with the extension-arm-mounting holes 51 in the frame 12. Fasteners 272 may extend through the attachment bracket 256 and threadably engage the extension-arm-mounting holes 51 to secure the extension arm 24 to the frame 12.

With reference to FIGS. 1-13, operation of the bow-sight mount 10 will be described in detail. As described above, the sight 28 may be mounted to the bow-sight mount 10, which in turn may be mounted to the bow 26. The bow-sight mount 10 is adjustable in a plurality of degrees of freedom to fine-tune a position of the sight 28 relative to the bow 26. The bow-sight mount 10 may be calibrated for a particular bow and arrow combination at a predetermined distance from a target. Thereafter, the bow-sight mount 10 can be adjusted relative to targets at different distances and wind velocities.

Figure 6:
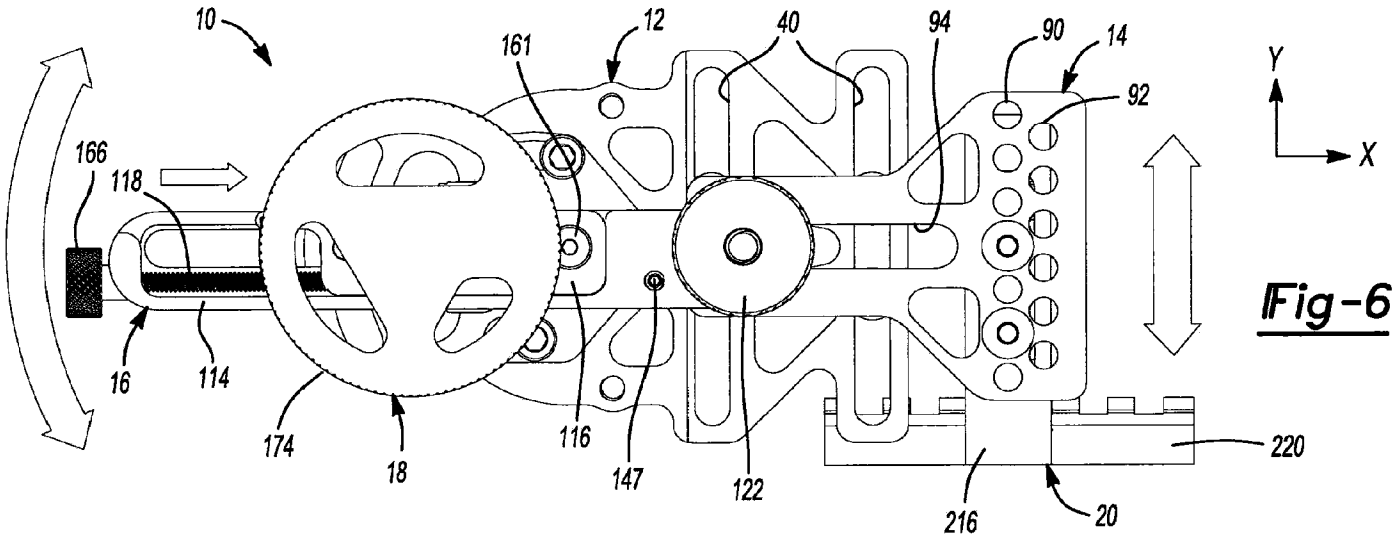
FIG. 6 is a side plan view of the bow-sight mount of FIG. 1 including a lever arm in a first position.
Figure 7:
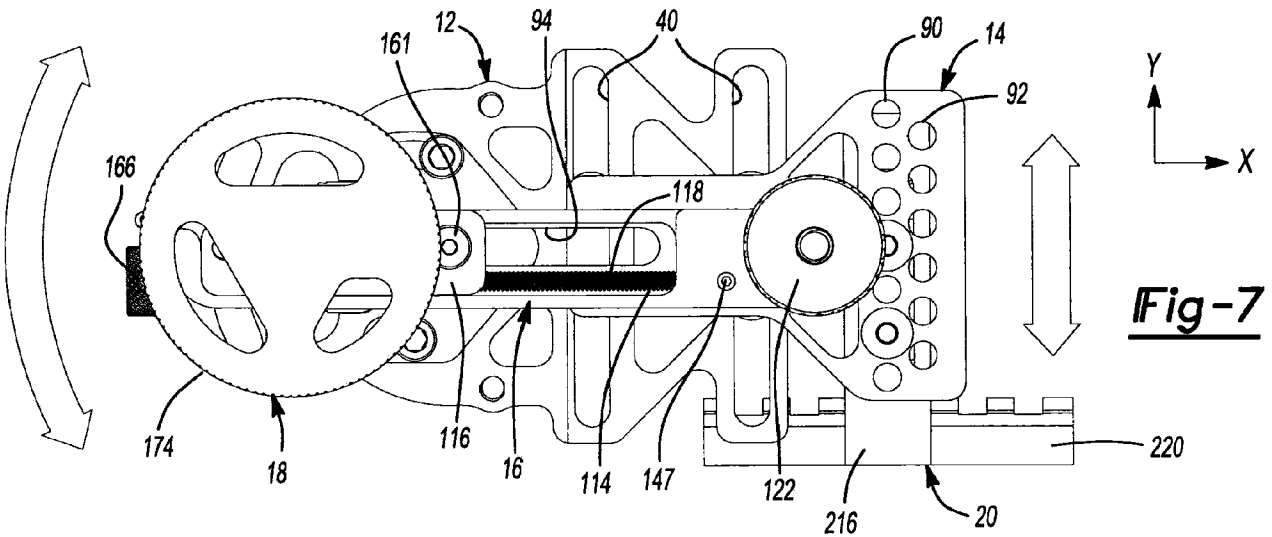
FIG. 7 is a side plan view of the bow-sight mount of FIG. 1 including a lever arm in a second position.
Figure 8:
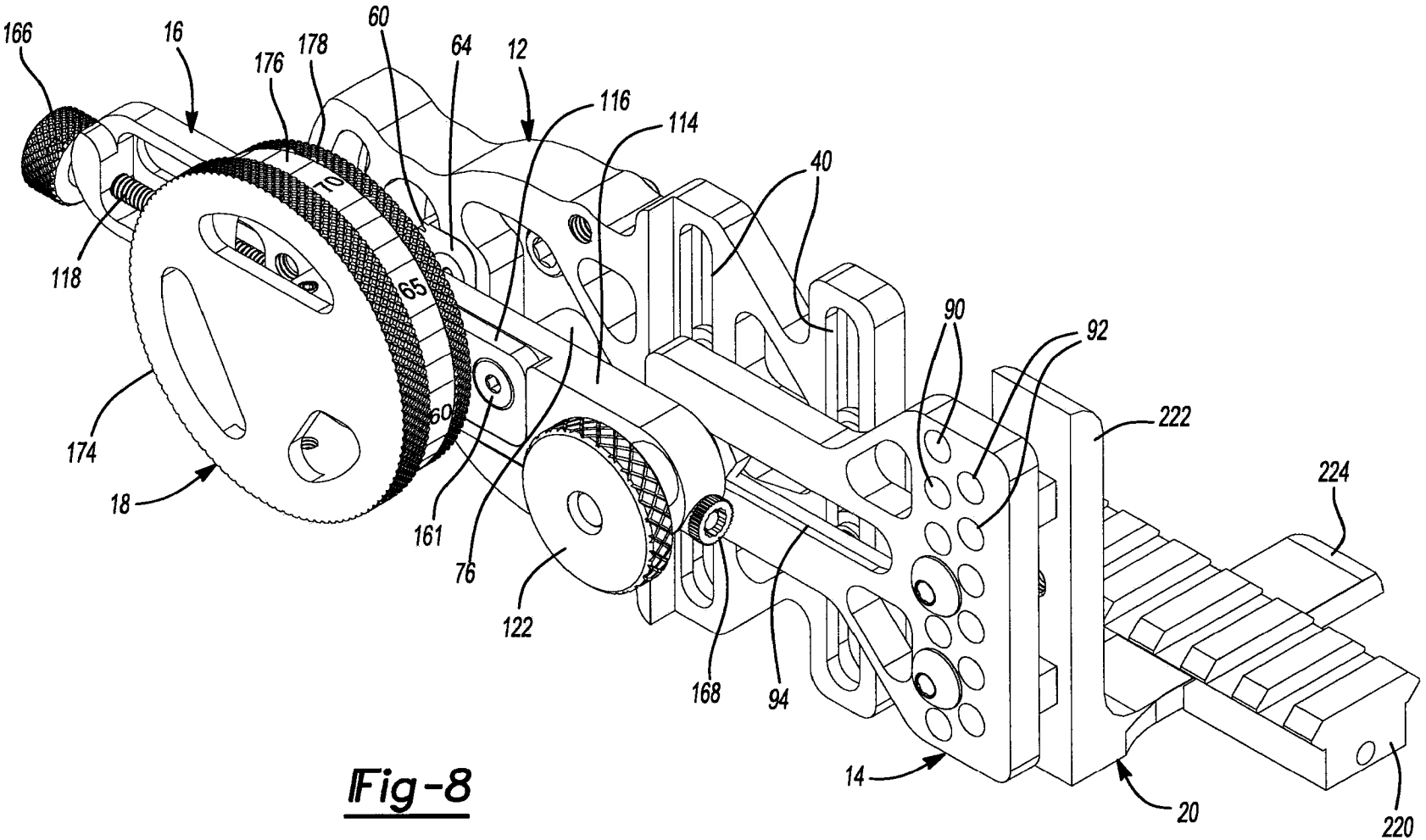
FIG. 8 is a perspective view of the bow-sight mount of FIG. 1.

As shown in FIGS. 6 and 7, the first-elongated member 114 is linearly movable in the third dimension X relative to the frame 12, the elevation member 14, and the elevation-adjustment mechanism 18 between a first position (FIG. 6) and a second position (FIG. 7). Twisting the adjustment knob 166 threadably translates the adjustment rod 118 through the fourth aperture 164 of the second-elongated member 116. Because the second-elongated member 116 is connected to the frame 12 at the pivot aperture 72 and the first-elongated member 114 is linearly fixed relative to the adjustment rod 118, the first-elongated member 114 moves linearly with the adjustment rod 118 relative to the second-elongated member 116.

As described above, the guide member 120 is fixed to the first-elongated member 114 at the third aperture 144 proximate the second end 130 thereof. As the first-elongated member 114 moves linearly relative to the frame 12, the elevation member 14, and the elevation-adjustment mechanism 18, the guide member 120 slides along the length of the guide slot 94 in the elevation member 14. As shown in FIGS. 6 and 7, an effective length of the lever arm 16 (i.e., a distance in the third dimension X between the guide member 120 and the axis A1 defining the pivot aperture 72) increases as the first-elongated member 114 moves from the first position (FIG. 6) toward the second position (FIG. 7).

Because the adjustment dial 174 is rotationally fixed relative to the rotation member 180, rotation of the adjustment dial 174 causes corresponding rotation of the gear portion 212 relative to the arcuately arranged teeth 60. Such rotation of the gear portion 212 relative to the arcuately arranged teeth 60 causes the lever arm 16 and the elevation-adjustment mechanism 18 to rotate about the axis A1 defining the pivot aperture 72. Rotation of the lever arm 16 causes corresponding linear motion of the elevation member 14 relative to the frame 12. That is, rotation of the adjustment dial 174 (and hence the lever arm 16) in a clockwise direction (relative to the views shown in FIGS. 6 and 7), causes the elevation member 14 to move downward (relative to the views shown in FIGS. 6 and 7) in the first dimension Y. Conversely, rotation of the adjustment dial 174 (and hence the lever arm 16) in a counterclockwise direction (relative to the views shown in FIGS. 6 and 7), causes the elevation member 14 to move upward (relative to the views shown in FIGS. 6 and 7) in the first dimension Y. The guide members 108 engaging the elevation member 14 and the guide slots 40 in the frame 12 transmit the rotational motion of the lever arm 16 into the above-described corresponding linear motion of the elevation member 14 relative to the frame 12 to adjust a position of the sight bracket 216 and, thus, a position of the sight 28 in the Y direction.

The effective length of the lever arm 16 (i.e., the distance between the guide member 120 and the axis defining the pivot aperture 72) determines the amount of linear travel of the elevation member 14 relative to the frame 12 that will result from a particular angular distance of rotation of the adjustment dial 174. For example, 360 degrees of rotation of the adjustment dial 174 will result in a greater amount of linear travel of the elevation member 14 if the first-elongated member 114 of the lever arm 16 is in the second position (FIG. 7) when compared to the amount of resulting linear travel of the elevation member 14 if the first-elongated member 114 of the lever arm 16 is in the first position (FIG. 6). The locking knob 122 may be selectively tightened to restrict movement of the first-elongated member 114 relative to the second-elongated member 116 and to restrict movement of the elevation member 14 relative to the frame 12.

As described above, the bow-sight mount 10 may be calibrated for a particular bow and arrow combination at a predetermined distance from a target. More specifically, the lever arm 16 and the elevation-adjustment mechanism 18 may be calibrated to account for bow-speed (i.e., a velocity of an arrow shot from the bow 26). The following is a description of the calibration process or method.

First, the locking knob 122 may be loosened relative to the first-elongated member 114 to allow unrestricted movement of the first-elongated member 114 relative to the second-elongated member 116 and unrestricted movement of the elevation member 14 relative to the frame 12. Then, a user may adjust the adjustment knob 166 to position the first-elongated member 114 relative to the second-elongated member 116 corresponding to a calibration setting for a particular bow-speed. This can be done by positioning the first-elongated member 114 relative to the second-elongated member 116 such that the indicator 152 on the second-elongated member 116 is aligned with the one of the bow-speed graduation marks 136 and/or numbers 138 (FIG. 4) on the first-elongated member 114 that correspond to the bow-speed of the particular bow 26. The numbers 138 may correspond to bow-speeds according to the table below, however, it should be appreciated that the table below is merely exemplary and the listings of bow-speeds and corresponding calibration settings are provided for illustration purposes only.

The bow-speed of any particular bow 26 may be determined based on a measured arrow-velocity and arrow-weight and may be published in an owner's manual associated with the bow 26. A user may tune the position of the first-elongated member 114 relative to the second-elongated member 116 to more precisely account for the bow-speed of any particular bow and arrow combination, as will be described in more detail below.

| Bow-Speed (Feet per Second) | Calibration Setting |
|---|---|
| 240 | 0 |
| 250 | 1 |
| 260 | 2 |
| 270 | 3 |
| 280 | 4 |
| 290 | 5 |
| 300 | 6 |
| 315 | 7 |
| 330 | 8 |
| 340 | 9 |
| 350 | 10 |

By way of example, the lever arm 16 may be positioned at calibration setting number ten in FIG. 4. The calibration setting number ten corresponds to the first position of the lever arm 16 (FIG. 6). Calibration setting number zero corresponds to the second position of the lever arm 16 (FIG. 7).

Once the lever arm 16 is adjusted according to the bow-speed of the particular bow 26, the bow-sight mount 10 can be calibrated to be on-target at a plurality of distances between the bow 26 and a target. First, the locking dial 178 of the elevation-adjustment mechanism 18 should be loosened relative to the range ring 176 to allow unrestricted rotation of the range ring 176 relative to the adjustment dial 174. Then, the user may aim and shoot an arrow at a target that is a known first predetermined distance away, such as twenty (20) yards, for example. If the shot is low relative to the target, for example, the adjustment dial 174 can be turned clockwise (relative to the views shown in FIGS. 6 and 7) to lower the elevation member 14 relative to the frame 12. Then, the user may aim and shoot another arrow at the same target from the first predetermined distance. If this shot is high, for example, the adjustment dial 174 can be turned counterclockwise (relative to the views shown in FIGS. 6 and 7) to raise the elevation member 14 relative to the frame 12. Such adjustments may be repeated until the bow-sight mount 10 is "sighted-in" at the first predetermined distance (i.e., aiming and shooting at the target from the first predetermined distance results in a shot that hits the intended target).

Once the bow-sight mount 10 is sighted-in at the first predetermined distance, the locking knob 122 may be tightened relative to the first-elongated member 114 to restrict or prevent movement of the first-elongated member 114 relative to the second-elongated member 116 and restrict or prevent movement of the elevation member 14 relative to the frame 12. If, as in the illustration described above, the first predetermined distance is twenty yards, the range ring 176 may then be rotated to align the range-graduation marks 200 and the number 202 corresponding to twenty yards on the range ring 176 with the indicator pin 158 extending from the second-elongated member 116. Then, the locking dial 178 may be tightened to secure the range ring 176 in this position relative to the adjustment dial 174.

Then, the locking knob 122 may be loosened relative to the first-elongated member 114 to allow unrestricted movement of the first-elongated member 114 relative to the second-elongated member 116 and unrestricted movement of the elevation member 14 relative to the frame 12. The adjustment dial 174 may then be adjusted to correspond to a second predetermined distance, such as forty yards, for example. The target may be placed at the second predetermined distance from the bow 26, and the user may aim and shoot an arrow at the target from the second predetermined distance. If, for example, the shot is high relative to the target, the adjustment knob 166 may be adjusted to move the lever arm 16 into a position corresponding to a faster bow-speed. Then, the user may aim and shoot another arrow from the second predetermined distance. If, for example, this shot is low relative to the target, the adjustment knob 166 may be adjusted to move the lever arm 16 into a position corresponding to a slower bow-speed. Such adjustments may be repeated until the bow-sight mount 10 is sighted-in at the second predetermined distance.

Once the bow-sight mount 10 is sighted-in at the second predetermined distance, the user should verify that the bow-sight mount 10 is still sighted-in at the first predetermined distance. If the bow-sight mount 10 is not still sighted-in at the first predetermined distance, the calibration process described above should be repeated for both the first and second predetermined distances.

Once the bow-sight mount 10 is sighted-in at both the first and second predetermined distances, the bow-sight mount 10 should be sighted-in (i.e., calibrated) for all distances for the particular bow and arrow combination. Therefore, the user may place the target at any known distance and adjust the adjustment dial 174 to correspond to that distance without further manipulating the adjustment knob 166. Aiming and shooting from that distance should result in the target being hit as intended.

To avoid inadvertent calibration adjustments of the range ring 176 relative to the adjustment dial 174, the set screw 204 (FIG. 5) may be threadably tightened in the threaded aperture 198 in the range ring 176 to secure the range ring 176 relative to the adjustment dial 174. Similarly, to avoid inadvertent calibration adjustments of the first-elongated member 114 relative to the second-elongated member 116, the set screw 147 (FIG. 5) may be threadably tightened in the threaded aperture 145 in the first-elongated member 114 and engage the adjustment rod 118 to prevent or restrict rotation of the adjustment rod 118 relative to the first and second elongated members 114, 116.

With reference to FIGS. 14-17, another bow-sight mount 10' is provided. In view of the substantial similarity in structure and function of the components associated with the bow-sight mount 10' with respect to the bow-sight mount 10, like reference numerals are used hereinafter and in the drawings to identify like components while like reference numerals containing a prime designation (') are used to identify components that have been modified.

The bow-sight mount 10' may include a frame 12', an elevation member 14, the lever arm 16, an elevation-adjustment mechanism 18', a sight-bracket assembly 20', the quiver-attachment bracket 22, and the extension arm 24. While the bow-sight mount 10' includes structural differences from the bow-sight mount 10 described below, calibration and operation of the bow-sight mount 10' is substantially similar to the calibration and operation of the bow-sight mount 10 described above. As such, calibration and operation of the bow-sight mount 10' will not be described in detail.

The frame 12' may be substantially similar to the frame 12 described above with the exception of guide slots 40'. The guide slots 40' may include a tapered recess 50' that slidably engages guide members 108 seated in tapered bushings 109'.

The elevation-adjustment mechanism 18' may include an adjustment dial 174', a range ring 176' and a rotation member 180'. The adjustment dial 174' may include a circumferential portion 182', the flat portion 184, and a boss 186'. The circumferential portion 182' may include a generally smooth hub portion 188' and the knurled rim 190. The boss 186' may include a first portion 284 extending axially from the inner surface 194 of the flat portion 184 in the second dimension Z and a second portion 286 extending axially from the first portion 284. A splined or threaded aperture 196' may extend at least partially through the second portion 286 and may extend into the first portion 284. The second portion 286 may rotatably engage the third aperture 162 of the second-elongated member 116. A washer 280 may be aligned with the third aperture 162 between the first-elongated member 114 and the frame 12'.

The range ring 176' may rotatably engage the hub portion 188' of the adjustment dial 174'. The range ring 176' may include the threaded aperture 198, the plurality of range-graduation marks 200, and the numbers 202 and/or other characters corresponding to at least some of the range-graduation marks 200. As described above, the threaded aperture 198 may receive the set screw 204 that may be tightened against the hub portion 188' to prevent or restrict relative rotation between the range ring 176' and the adjustment dial 174' or loosened relative to the hub portion 188' to allow unrestricted rotation of the range ring 176' relative to the hub portion 188'.

An end face 290 of the range ring 176' may include a plurality of detents 292. Spacing between adjacent detents 292 corresponds to a predetermined distance or range. By way of non-limiting example, each of the detents 292 may correspond to each of the range-graduation marks 200. A detent plunger 294 and spring 296 may be received in a recess 297 in the second-elongated member 116' and may be aligned relative to the range ring 176' such that the spring 296 may urge a tip 298 of the detent plunger 294 into engagement with one of the detents 292. As the range ring 176' rotates relative to the second-elongated member 116, a plurality of the detents 292 may move into and out of engagement with the detent plunger 294. Moving one of the detents 292 into engagement with the detent plunger 294 may generate an audible click or other sound indicating that the range ring 176' has been rotated an amount corresponding to the predetermined distance or range associated with the spacing between adjacent detents 292.

The rotation member 180' may include a head portion 300, a splined or threaded shaft portion 302 and a gear portion 304. The shaft portion 302 may extend through an aperture 305 in the gear portion 304, through the washer 280 and may be press-fit, threadably engaged or otherwise secured within the aperture 196' in the adjustment dial 174'. The gear portion 304 may be disposed between the head portion 300 and the washer 280 and may meshingly engaging the teeth 60 in the frame 12'. In this manner, rotation of the adjustment dial 174' causes corresponding geared movement of the gear portion 304 relative to the teeth 60, which in turn causes rotation of the lever arm 16 about the pivot aperture 72. The rotation member 180' may include a multiple-piece construction (shown in FIG. 15). In some embodiments, the rotation member 180' may be a single component, such that the head portion 300, the shaft portion 302 and the gear portion 304 are integrally formed with each other.

The sight-bracket assembly 20' may include a first leg 222', a discrete second leg 224', a ball bearing 306 (or other spherical member), a plurality of fasteners 308, and a plurality of biasing members 310. The first leg 222' may include plurality of first-threaded apertures 312, a plurality of second apertures 314, and a first socket 316. The plurality of first-threaded apertures 312 may be aligned with a selected plurality of the first-mounting apertures 90 or a selected plurality of the second-mounting apertures 92 in the elevation member 14 such that fasteners 238 may engage the selected mounting apertures 90 or 92 and the first-threaded apertures 312 to secure the first leg 222' to the elevation member 14. The plurality of second apertures 314 may be arranged in a cross-shaped pattern centered about the first socket 316, i.e., a first pair of the second apertures 314 are aligned with each other and the first socket 316 in the first dimension Y and a second pair of the second apertures 314 are aligned with each other and the first socket 316 in the third dimension X.

The second leg 224' may include a first end face 318 having a plurality of third-threaded apertures 320 and a second socket 322. The third-threaded apertures 320 may be arranged in a cross-shaped pattern centered about the second socket 322. Each of the third-threaded apertures 320 may be aligned with a corresponding one of the second apertures 314 in the first leg 222'. Similarly, the first and second sockets 316, 322 may be aligned with each other.

Each of the plurality of fasteners 308 engages a corresponding one of the second apertures 314 and a corresponding one of the third-threaded apertures 320 to secure the first and second legs 222', 224' to each other. Each of the plurality of biasing members 310 may engage a corresponding one of the plurality of fasteners 308 and may be disposed between the first and second legs 222', 224' to urge the first and second legs 222', 224' apart from each other. The biasing members 310 may include spring washers, helical compression springs, and/or any other resiliently compliant member. The ball bearing 306 may be disposed between the first and second legs 222', 224 and may engage the first and second sockets 316, 322. Each of the first and second sockets 316, 322 may receive less than half of the ball bearing 306. In this manner, the second leg 224' may be pivotable relative to the first leg 222' about ball bearing 306.

The second leg 224' may be adjusted relative to the first leg 222' by varying the torque of one or more of the fasteners 308. For example, loosening a first selected one of the fasteners 308 allows the corresponding biasing member 310 to urge the second leg 224' to pivot in the direction of the first selected one of the fasteners 308. The second leg 224' may be pivoted back in the opposite direction by re-tightening the first selected fastener 308 and/or loosening a second selected one of the fasteners 308 opposite the ball bearing 306.

Figure 18:
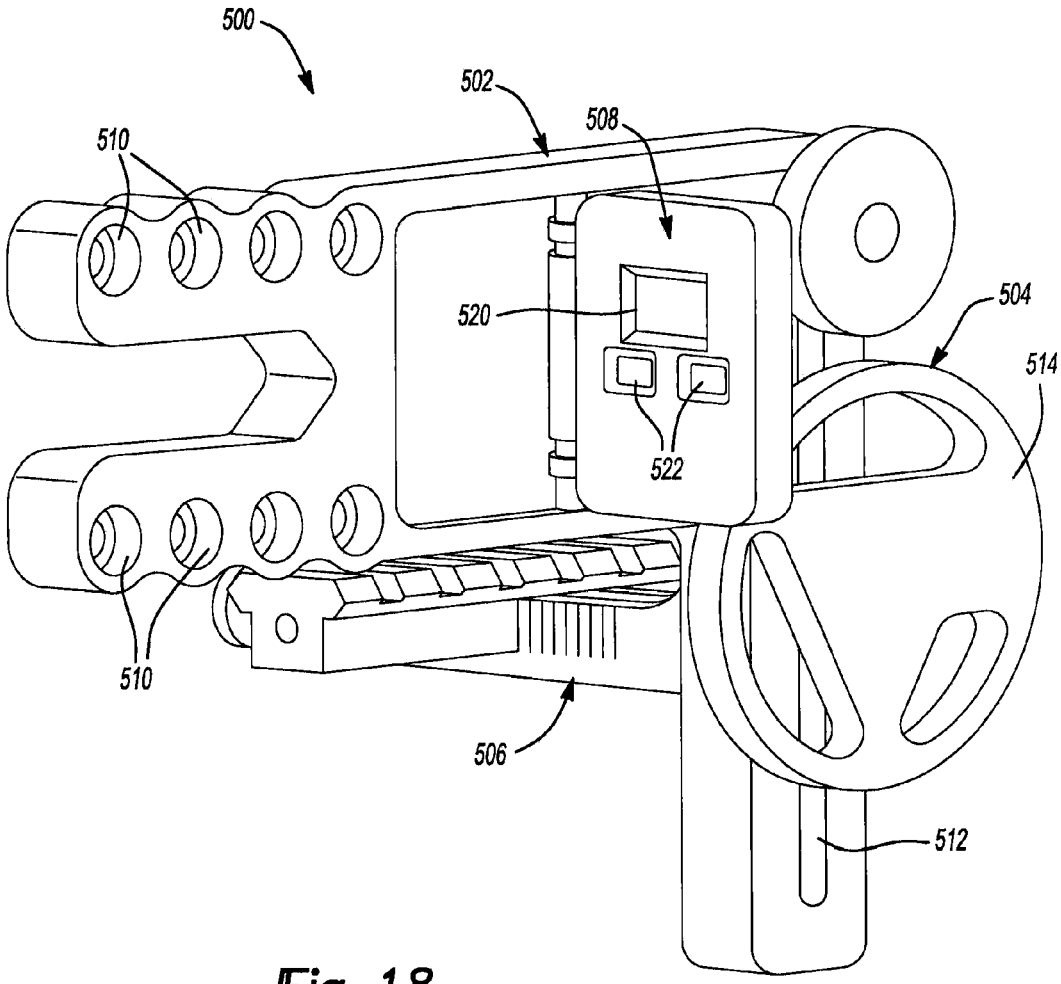
FIG. 18 is a perspective view of a bow-sight mount according to the principles of the present disclosure.

With reference to FIG. 18, another bow-sight mount 500 is provided. The bow-sight mount 500 may include a frame 502, an elevation-adjustment mechanism 504, an elevation member 506, and a processor 508. The bow-sight mount 500 may be mounted to the bow 26. The frame 502 may be a generally L-shaped member including a plurality of mounting apertures 510 and a slot 512, whereby the slot 512 includes a gear rack (not shown).

The elevation-adjustment mechanism 504 may include an adjustment knob 514 having a geared pinion (not shown) member fixed relative thereto. The pinion member may meshingly engage the gear rack in the slot 512 of the frame 502. The pinion member may also engage the elevation member 506 such that rotation of the pinion relative to the gear rack causes corresponding linear motion of the elevation member 506 relative to the frame 502. A sight or optic (not shown) may be mounted to the elevation member 506. A position sensor (not shown) may be mounted to the frame 502, for example, to sense a position of the sight or optic relative to the frame 502. The position sensor may communicate this information to the processor 508.

The processor 508 may include a digital display 520 and one or more user-input buttons 522. The processor 508 may be mounted to the frame 502 and may be in communication with a potentiometer (not shown), which, in turn, is in communication with the elevation-adjustment mechanism 504. The potentiometer may communicate to the processor 508 a linear position of the elevation-adjustment mechanism 504 (and hence the elevation member 506) relative to the frame 502. Based on the information received from the potentiometer and a calibrated bow-speed, the processor 508 may determine a range at which the user may position the bow 26 to aim and shoot an arrow and hit a target. This range may be displayed on the digital display 520.

The following procedure may be used to calibrate the bow-sight mount 500 for bow-speed. The user may adjust the elevation-adjustment mechanism 504 until the user is able to aim and shoot an arrow and hit the target at a first predetermined distance. When the target is hit at the first predetermined distance, the user may press one of the user-input buttons 522, causing the processor 508 to establish a first calibration point. Then, the user may select a second predetermined distance and adjust the elevation-adjustment mechanism 504 until the user is able to aim and shoot an arrow and hit the target at the second predetermined distance. When the target is hit at the second predetermined distance, the user may press one of the user-input buttons 522, causing the processor 508 to establish a second calibration point. The processor 508 may calibrate the bow-sight mount 500 based on the first and second calibration points and the relative position of the elevation-adjustment mechanism 504 during establishment of the first calibration point and the second calibration point.

While the sight mount 10 is described above as including the quiver-attachment bracket 22 and the extension arm 24, the sight mount 10 need not include the quiver-attachment bracket 22 or the extension arm 24 and is fully functional without the quiver-attachment bracket 22 and/or the extension arm 24. Furthermore, while the sight mounts 10, 10', 500 are described above as being aiming systems for the archery bow 26, the sight mounts 10, 10', 500 could also be used with other types of weaponry, such as a crossbow or firearm, for example.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A sight mount comprising:

a frame;

a first bracket slidably supported by said frame;

an arm rotatably attached to said first bracket at a first pivot point and rotatably supported by said frame at a second pivot point;

a first adjustment assembly operable to adjust a distance between said first pivot point and said second pivot point; and a second adjustment assembly including a rotatable wheel operable to pivot said arm about said second pivot in response to rotation of said wheel relative to said frame to move said first bracket relative to said frame.

2. The sight mount of claim 1, wherein said arm includes a first member and a second member, said first member being slidably attached to said second member and pivotably attached to said first bracket at said first pivot point.

3. The sight mount of claim 2, wherein said first adjustment assembly includes an adjustment rod threadably received within said first member to cause said first member to move relative to said frame when said adjustment rod is rotated relative to said frame.

4. The sight mount of claim 2, wherein one of said first member and said second member includes a plurality of graduations and the other of said first member and said second member includes a reference mark, said plurality of graduations and said reference mark cooperating to position said first member relative to said second member to adjust said distance between said first pivot point and said second pivot point.

5. The sight mount of claim 1, further comprising a gear formation supported by said frame and in meshed engagement with a shaft fixed for rotation with said wheel, said gear formation causing said arm to pivot about said second pivot point when said wheel is rotated relative to said frame.

6. The sight mount of claim 5, wherein said gear formation is formed integrally with said frame.

7. The sight mount of claim 5, wherein said gear formation is formed in a discrete member that is fixedly attached to said frame.

8. The sight mount of claim 5, wherein said shaft includes a first end that fixes said shaft for rotation with said wheel and a series of gear teeth that mesh with said gear formation.

9. The sight mount of claim 1, wherein said wheel includes a plurality of graduations and said arm includes a reference point, said plurality of graduations cooperating with said reference point to position said wheel in a desired rotational position relative to said frame to position said first bracket relative to said frame.

10. The sight mount of claim 9, wherein said wheel includes a plurality of detents, each of said plurality of detents corresponding to one of said plurality of graduations.

11. The sight mount of claim 10, further comprising a detent plunger that selectively engages said detents to produce an audible indication of an amount of rotation of said wheel relative to said frame.

12. The sight mount of claim 9, wherein said plurality of graduations are disposed on a range ring that is selectively rotatable relative to said wheel.

13. The sight mount of claim 12, further comprising a locking mechanism operable to selectively prevent movement of said range ring relative to said wheel.

14. The sight mount of claim 1, further comprising a rail fixed for movement with said first bracket relative to said frame.

15. The sight mount of claim 14, wherein said rail is rotatable relative to said first bracket.

16. The sight mount of claim 14, wherein said first bracket includes a first series of apertures and a second series of apertures substantially parallel to said first series of apertures, said first series of apertures and said second series of apertures operable to position said rail in a plurality of positions relative to said first bracket.

17. The sight mount of claim 16, wherein at least two of said second apertures are each positioned between a pair of said first apertures.

18. The sight mount of claim 1, further comprising a second bracket mounted to said first bracket and operable to support an optical component.

19. The sight mount of claim 18, wherein said second bracket includes a ball member, a first member, and a second member mounted to said first member for relative pivotable motion therebetween about at least two axes, said first member including a first socket partially receiving said ball member, said second member including a second socket partially receiving said ball member.

20. A sight mount comprising:

a frame;

an arm rotatably supported by said frame about a first pivot point;

a first bracket rotatably supported by said arm and slidably supported by said frame; and an adjustment wheel rotatably supported by said frame and operable to rotate said arm about said first pivot to adjust a position of said arm relative to said frame, said adjustment wheel including a plurality of detents selectively engaging said arm to produce an audible indication of an amount of rotation of said adjustment wheel.

21. The sight mount of claim 20, wherein said adjustment wheel includes a plurality of graduations and said arm includes a reference point, said plurality of graduations cooperating with said reference point to indicate a position of said wheel relative to said frame and a position of said arm relative to said frame.

22. The sight mount of claim 21, wherein each of said plurality of detents corresponds to one of said plurality of graduations.

23. The sight mount of claim 20, wherein said plurality of detents are disposed on a range ring attached to said adjustment wheel.

24. The sight mount of claim 23, further comprising a locking mechanism operable to selectively prevent movement of said range ring relative to said adjustment wheel.

25. The sight mount of claim 20, further comprising a rail attached to said first bracket and operable to support a sight.

26. The sight mount of claim 25, wherein said first bracket includes a first series of apertures and a second series of apertures substantially parallel to said first series of apertures, said first series of apertures and said second series of apertures operable to position said rail in a plurality of positions relative to said first bracket.

27. The sight mount of claim 26, wherein a first one of said second apertures is positioned between a first pair of adjacent first apertures and a second one of said of said second apertures is positioned between a second pair of adjacent first apertures.

28. The sight mount of claim 20, further comprising a second bracket mounted to said first bracket and operable to support a sight.

29. The sight mount of claim 28, wherein said second bracket includes a ball member, a first member, and a second member mounted to said first member for relative pivotable motion therebetween about at least two axes, said first member including a first socket partially receiving said ball member, said second member including a second socket partially receiving said ball member.

30. The sight mount of claim 20, wherein said arm is attached to said first bracket at a second pivot point and is operable to translate said first bracket relative to said frame when said arm pivots about said first pivot point.

31. The sight mount of claim 30, further comprising an adjustment assembly operable to adjust a distance between said first pivot point and said second pivot point.

32. The sight mount of claim 20, wherein said arm supports a detent plunger for engagement with said plurality of detents.

33. A sight mount comprising:

a frame;

a first bracket supported by said frame for movement relative thereto and including a first socket;

a second bracket supported by said first bracket and operable to support a sight, said second bracket including a second socket;

a ball member at least partially received within said first socket and at least partially received within said second socket and operable to allow said second bracket to pivot about at least two axes relative to said first bracket.

34. The sight mount of claim 33, further comprising an adjustment mechanism supported by and movable relative to said frame and operable to cause corresponding movement of said first bracket and said second bracket relative to said frame.

35. The sight mount of claim 33, further comprising a plurality of resiliently compressible members disposed between said first bracket and said second bracket.

36. The sight mount of claim 35, further comprising a plurality of threaded fasteners engaging said first bracket and said second bracket, said plurality of fasteners operable to apply a force on said second bracket to move said second bracket relative to said first bracket about at least one of said at least two axes.

37. The sight mount of claim 33, further comprising a plurality of threaded fasteners engaging said first bracket and said second bracket, said plurality of fasteners operable to apply a force on said second bracket to move said second bracket relative to said first bracket about at least one of said at least two axes.

38. The sight mount of claim 33, further comprising a third bracket slidably mounted to said frame and supporting said first bracket.

39. The sight mount of claim 38, wherein said third bracket includes a first series of apertures and a second series of apertures substantially parallel to said first series of apertures, said first series of apertures and said second series of apertures operable to position said first bracket in a plurality of positions relative to said third bracket.

40. The sight mount of claim 39, wherein a first one of said second apertures is positioned between a first pair of adjacent first apertures and a second one of said of said second apertures is positioned between a second pair of adjacent first apertures.

41. The sight mount of claim 38, further comprising an arm rotatably attached to said third bracket at a first pivot point and rotatably supported by said frame at a second pivot point.

42. The sight mount of claim 41, further comprising an adjustment assembly operable to adjust a distance between said first pivot point and said second pivot point.

43. The sight mount of claim 42, wherein said adjustment assembly includes an adjustment wheel rotatably supported by said frame and operable to pivot said arm about said second pivot point.

44. The sight mount of claim 43, wherein said wheel includes a plurality of detents operable to make an audible noise when said wheel is rotated relative to said arm.

* * * * *